US005754971A

United States Patent [19]

Matsumoto et al.

[11] Patent Number: 5,754,971

[45] Date of Patent: May 19, 1998

[54] FAULT DIAGNOSIS APPARATUS FOR A FUEL EVAPORATIVE EMISSION SUPPRESSING APPARATUS

[75] Inventors: Takuya Matsumoto; Mitsuhiro Miyake; Toru Hashimoto, all of Kyoto; Toshiro Nomura; Hidetsugu Kanao, both of Okazaki, all of Japan

[73] Assignee: Mitsubishi Jidosha Kogyo Kabushiki Kaisha, Tokyo, Japan

[21] Appl. No.: 599,313

[22] Filed: Feb. 9, 1996

[30] Foreign Application Priority Data

Feb. 10, 1995 [JP] Japan ..... 7-023183

[51] Int. Cl.[6] ..... G06G 7/70; F02D 41/00

[52] U.S. Cl. ..... 701/103; 701/101; 701/99; 123/698; 123/519; 123/198 D; 123/520; 73/118.1

[58] Field of Search ..... 364/431.03, 431.061, 364/431.062, 431.052, 431.051; 123/198 D, 519, 520, 698, 538, 421, 417, 480, 690, 518, 506, 357; 60/285, 284; 73/40, 49.7, 118.1

[56] References Cited

U.S. PATENT DOCUMENTS

| | | | |
|---|---|---|---|
| 4,308,841 | 1/1982 | Kingsley | 123/520 |
| 5,176,123 | 1/1993 | Hosoda et al. | 123/520 |
| 5,203,870 | 4/1993 | Kayanuma et al. | 123/198 D |
| 5,239,858 | 8/1993 | Rogers et al. | 73/118.1 |
| 5,251,477 | 10/1993 | Nakashima et al. | 73/118.1 |
| 5,295,472 | 3/1994 | Otsuka et al. | 123/520 |
| 5,297,527 | 3/1994 | Suzuki et al. | 123/520 |
| 5,333,589 | 8/1994 | Otsuka | 123/520 |
| 5,408,866 | 4/1995 | Kawamura et al. | 73/118.1 |
| 5,445,015 | 8/1995 | Namiki et al. | 73/118.1 |
| 5,448,980 | 9/1995 | Kawamura et al. | 123/520 |
| 5,477,842 | 12/1995 | Maruyama et al. | 123/690 |
| 5,485,596 | 1/1996 | Igarashi et al. | 364/431.03 |
| 5,495,842 | 3/1996 | Yamanaka et al. | 123/520 |
| 5,575,267 | 11/1996 | Matsumoto et al. | 123/698 |

*Primary Examiner*—Jacques H. Louis-Jacques

[57] ABSTRACT

A fault diagnosis apparatus for a fuel evaporative emission suppressing system has an electronic control unit which inputs an average value of integral terms for air-fuel ratio feedback control, engine speed, etc. when diagnosis executing conditions are satisfied, and then starts opening operation of a purge control valve. Subsequently, the average value of integral terms, engine speed, etc. are input again. If no substantial change occurs in the average value, etc. with driving of the purge control valve, it is concluded that purge air for fault diagnosis has not been introduced, and that the suppressing system is faulty. In driving the purge control valve, its driving duty ratio is increased by a relatively small increment till the driving duty ratio reaches a predetermined duty ratio. If the system is normal, therefore, a purge-air introduction amount for fault diagnosis is increased by a relatively small increasing degree, to thereby prevent fluctuation of the air-fuel ratio or engine output torque attributable to the purge air introduction. After the driving duty ratio has reached the predetermined duty ratio, the driving duty ratio is increased by a relatively large increment, to thereby rapidly execute the purge-air introduction and fault diagnosis.

18 Claims, 14 Drawing Sheets

FAULT DIAGNOSIS APPARATUS FOR A FUEL EVAPORATIVE EMISSION SUPPRESSING APPARATUS

BACKGROUND OF THE INVENTION

1. Field of the Invention

This invention relates to a fault diagnosis apparatus for a fuel evaporative emission suppressing system installed on an engine, and more particularly to, an apparatus for executing fault diagnosis of a fuel evaporative emission suppressing system while preventing drivability of an engine from worsening as much as possible.

2. Description of the Related Art

In order to prevent air pollution and the like, the engine and body of an automobile are provided with various devices for treating harmful emission components. These known devices include, for example, a blow-by gas recirculating device for guiding a blow-by gas, which consists mainly of an unburned fuel components (HC) leaking from a combustion chamber of an engine into a crank case, to an intake pipe, and a fuel evaporative emission suppressing system for guiding a fuel evaporative gas, composed mainly of HC produced in a fuel tank, into the intake pipe.

The fuel evaporative emission suppressing device comprises a canister, loaded with activated charcoal which adsorbs the fuel evaporative gas, a large number of pipes, etc. The canister is provided with an inlet port, outlet port, and vent port which open into the fuel tank, intake pipe, and atmosphere, respectively. In the fuel evaporative emission suppressing device of this canister-storage type, the fuel evaporative gas generated in the fuel tank is introduced into the canister and made to be adsorbed by the activated charcoal. Atmospheric air is introduced into the canister through the vent port by applying a negative pressure generated in the intake pipe to the outlet port. The fuel evaporative gas adsorbed by the activated charcoal is separated therefrom by means of the atmospheric air, and the separated gas is introduced into the intake pipe as a purge air. The fuel evaporative gas, thus delivered into the intake pipe, is burned in the combustion chamber of the engine, whereby it is prevented from being discharged into the atmosphere.

If the purge air containing the fuel evaporative gas is introduced carelessly into the intake pipe, however, the air-fuel ratio of an air-fuel mixture deviates from its appropriate range, so that the rotational speed and output torque of the engine fluctuate greatly. Accordingly, the comfortableness to drive or drivability of the vehicle worsens. This unfavorable phenomenon is particularly remarkable in a case where the purge air is introduced while the engine is running in an idling area in which the quantity of intake air is small.

To avoid this, a purge control valve, for use as purge regulating means for controlling the rate of purge air introduction, is provided in a purge passage which connects the canister and the intake pipe. The purge control valve is opened to allow the purge air to be introduced into the engine only when the engine is operating in a predetermined operation area. In general, purge control valves may be classified into two types, mechanical ones which operate in response to negative intake pressure and electrical ones which are controlled in on-off operation by means of an electronic control unit in accordance with pieces of operation information, such as throttle opening, intake air flow rate, etc. Although the mechanical valves, low-priced, are widely used, the electrical or solenoid-operated valves are superior in performance, since the introduction and shut-off of the purge air can be controlled more accurately and freely by the electrical ones.

In the fuel evaporative emission suppressing device furnished with a solenoid-operated purge control valve, however, snapping of wires which connect the ECU and the purge control valve, connector contact failure, etc. may occur, or a valve plug in the control valve may possibly be fixed in a closed state from some cause. In such a case, the purge air cannot be introduced into the intake pipe, so that the canister is overloaded with the fuel evaporative gas. Inevitably, therefore, the fuel evaporative gas additionally supplied from the fuel tank is discharged into the atmosphere without being adsorbed by the activated charcoal.

Naturally, however, the discharge of the fuel evaporative gas into the atmosphere constitutes no hindrance to the engine operation. Thus, a driver can hardly be aware of this fault as the fuel evaporative gas continues to be discharged into the atmosphere for a long period of time.

Unexamined Japanese Patent Publications Nos. 3-213652 and 4-12157 disclose an apparatus for diagnosing a fault in a purge system by forcibly introducing the purge air during idling operation, etc. and by detecting a change in the operating state at that time. However, in this apparatus, the purge air is introduced by opening a PCV at a time in a fault diagnosis, and the following unfavorable phenomena might occur: when an automobile is parked for a long time during summer or the like when the outside air temperature is high, for example, a lot of fuel evaporative gas is adsorbed by the canister, and a fuel-evaporative-gas content in the purge air is extremely increased. If the PCV is opened at a time in such an occasion, the fuel evaporative gas will flow into the intake pipe in a large amount, and overrich mixture which contains excessive amount of fuel component flows into the combustion chamber. As a result, torque fluctuation or insufficient combustion takes place, so that idling operation might not proceed smoothly, or harmful emission components in the emission might increase.

In order to eliminate such drawbacks, an attempt has been made that a driving duty ratio of the PCV is increased at a small increase rate so as to gradually increase the rate of the purge air introduction. This makes it possible to prevent the mixture from being rapidly and excessively enriched, but it takes time for the PCV to have a predetermined opening degree (full open, for example). Thus, in a case where the engine operating state is changed due to manipulation of an accelerator pedal, etc. during that time, the engine operating state deviates from the predetermined one for fault diagnosis. This results in another drawback that fault diagnosis cannot be made.

SUMMARY OF THE INVENTION

An object of the present invention is to provide an apparatus for securely and rapidly diagnosing a fault of a PCV or clogging of piping in a fuel evaporative emission suppressing system while preventing drivability of an engine from worsening as much as possible.

According to the present invention, there is provided a fault diagnosis apparatus for a fuel evaporative emission suppressing system in which a purge air is introduced into an intake passage through a purge passage, the purge air containing a fuel evaporative gas produced in a fuel supply system of an engine mounted on a vehicle and an atmospheric air. The fault diagnosis apparatus comprises: a purge regulating means for regulating an introduction amount of the purge air; a purge-air increasing means for controlling the purge regulating means so that a change rate of the introduction amount of the purge air is increased stepwise or continuously with elapse of time; an operating state detecting means for detecting an operating state information quantity representing an operating state of at least one of the vehicle, the engine, and means for controlling the engine; and a diagnosing means for diagnosing a fault of the fuel evaporative emission suppressing system based on the operating state information quantity detected by the operating state detecting means after the purge air increasing means starts control of the purge regulating means.

In the above-mentioned fault diagnosing apparatus, the purge-air increasing means operates the purge regulating means, to carry out the purge air introduction for fault diagnosis. If the fuel evaporative emission suppressing system including the purge regulating means is normal, the purge regulating means operates so as to introduce the purge air into the engine through the purge passage and the intake passage, whereby the engine operating state is changed. On the other hand, if the fuel evaporative emission suppressing system is faulty and hence the purge regulating means is not operated, for example, the purge air will not be introduced into the engine and the engine operating state will not be changed. The diagnosing means concludes the fuel evaporative emission suppressing system to be faulty when it determines, based on the operating state information quantity detected by the operating state change detecting means, that the operating state has not been changed.

The purge-air increasing means controls the purge regulating means so as to increase the change rate of the purge-air introduction amount with elapse of time. As a result, if the fuel evaporative emission suppressing system including the purge regulating means is normal, the purge-air introduction amount is gradually increased. Moreover, the purge air in an amount required for fault diagnosis is introduced in a short period of time. As the purge-air introduction amount is gradually increased, torque fluctuation or insufficient combustion in the engine caused by overrich mixture due to excessive introduction of purge air is relaxed. Also, as the purge air is introduced in a short period of time, fault diagnosis can be made securely and rapidly. Even in a case where such a requirement is provided that the engine must be in a particular operating state during the fault diagnosis, the fault diagnosis is prevented from being inexecutable since there is a reduced possibility that the engine deviates from the particular operating state after the purge regulating means starts to be operated.

Preferably, the purge regulating means operates in response to a commanded operation quantity sent out of the purge-air increasing means, and the purge-air increasing means controls the purge regulating means so that the introduction amount of the purge air is increased at a first change rate till the commanded operation quantity reaches a predetermined quantity, and that the introduction amount of the purge air is increased at a second change rate greater than the first change rate after the commanded operation quantity reaches the predetermined quantity.

In this preferred embodiment, the purge regulating means is controlled so that the purge-air introduction amount is increased at a relatively small first change rate till the commanded operation quantity sent out to the purge regulating means reaches the predetermined quantity. Thus, when the fuel evaporative emission suppressing system including the purge regulating means is normal, the purge-air introduction amount is gradually increased till the purge-air introduction amount reaches a predetermined amount, whereby excessive purge air introduction can be prevented. Further, after the commanded operation quantity reaches the predetermined quantity, operation of the purge regulating means is controlled so that the purge-air introduction amount is increased at a second change rate greater than the first change rate. Thus, introduction of the purge air is promoted, and the purge air in an amount required for fault diagnosis is introduced into the engine in a short period of time. On the other hand, if the fuel evaporative emission suppressing system is faulty and the purge regulating means is not operated, for example, the purge air is not introduced.

More preferably, the predetermined quantity is an operation quantity of the purge regulating means which realizes introduction of the purge air in an amount to generate a significant change in the operating state information quantity when the purge regulating means is normal. In this case, if the fuel evaporative emission suppressing system including the purge regulating means is normal, when or before the commanded operation quantity sent out to the purge regulating means reaches the predetermined quantity, that is, while the purge-air introduction amount is increased at the first change rate, a significant change usually takes place in the operating state information quantity, and fault diagnosis is finished. Thus, in usual, diagnosis is finished before the purge-air introduction amount begins to be increased at the second change rate, and torque fluctuation or sufficient combustion caused by supply of overrich mixture, etc. can be relaxed.

Alternatively, the purge-air increasing means controls the purge regulating means so that the introduction amount of the purge air is increased at the first change rate till a predetermined time period has elapsed from the moment when the control was started, and controls the purge regulating means so that the introduction amount of the purge air is increased at the second change rate greater than the first change rate after the predetermined time period has elapsed.

In this preferred embodiment, while the purge regulating means is controlled by the purge-air increasing means, the purge regulating means is controlled so that the purge-air introduction amount is increased at the first change rate till the predetermined time period has elapsed from the start of the control. Thus, if the fuel evaporative emission suppressing system including the purge regulating means is normal, the purge-air introduction amount is gradually increased, whereby torque fluctuation or insufficient combustion caused by the supply of overrich mixture, etc. can be relaxed. When the predetermined time period has elapsed from the start of the control, the purge-air introduction amount is increased at the second change rate greater than the first change rate, whereby fault diagnosis can be made securely and rapidly.

More preferably, the predetermined time period is an operation time period of the purge regulating means which realizes introduction of the purge air in an amount to generate a significant change in the operating state information quantity when the purge regulating means is normal. In this case, if the fuel evaporative emission suppressing system including the purge regulating means is normal, when or before the predetermined time period has elapsed from the moment when the control of the purge regulating means by the purge-air increasing means was started, a significant change usually takes place in the operating state information quantity, and fault diagnosis is finished. Thus, the diagnosis is usually finished before the purge-air introduction amount is increased at the second change rate, and torque fluctuation or insufficient combustion caused by the supply of overrich mixture, etc. can be relaxed.

In the above two preferred embodiments in which the increasing degree of the change rate for the purge-air introduction amount is changed in accordance with the commanded operation quantity or the elapsed time period, preferably, the diagnosing means repeats fault diagnosis of the fuel evaporative emission suppressing system as long as a variation of the operating state information quantity observed from the moment when the purge-air increasing means started control of the purge regulating means is less than a predetermined decision reference value. The diagnosing means concludes that the fuel evaporative emission suppressing system is normal, if the variation of the operating state information quantity exceeds the predetermined decision reference value. In this case, when the variation of the operating state information quantity observed from the moment when the purge-air increasing means started control of the purge regulating means exceeds the predetermined decision reference value, the fuel evaporative emission suppressing system is concluded to be normal. By this, accuracy of fault diagnosis is improved.

In the above-mentioned two preferred embodiments, preferably, the diagnosing means concludes that the fuel evaporative emission suppressing system is faulty, if the variation of the operating state information quantity observed from the moment when the purge-air increasing means started control of the purge regulating means to the moment when the commanded operation quantity or the elapsed time period has reached a predetermined upper limit is less than a predetermined decision reference value. In this case, when the commanded operation quantity sent out from the purge-air increasing means to the purge regulating means reaches the predetermined upper limit, or when the elapsed time from the moment when the purge-air increasing means started control of the purge regulating means reaches the predetermined upper limit, the variation of the operating state information quantity observed from the moment when the purge-air increasing means started control of the purge regulating means to the moment when the commanded operation quantity or the elapsed time has reached the upper limit value is judged. If the fuel evaporative emission suppressing system including the purge regulating means is normal, a sufficient amount of purge air has been already introduced by the time point at which the judgment is made, and hence a significant change has already taken place in the engine operating state. Thus, if the variation of the operating information amount till the moment when the commanded operation quantity or the elapsed time has reached the upper limit value is less than the decision reference value, the fuel evaporative emission suppressing system is judged to be faulty. By this, erroneous diagnosis at a transitional stage of the purge air introduction can be prevented, and accuracy of fault diagnosis is improved.

In the aforementioned preferred embodiment in which the increasing degree of the change rate of the purge-air introduction amount is changed according to the commanded operation quantity, preferably, the purge regulating means includes a purge regulating valve which is opened and closed in accordance with a commanded duty ratio sent out of the purge-air increasing means, to thereby regulate a flow rate of the purge air flowing through the purge passage. The purge-air increasing means changes the commanded duty ratio so as to increase at a first duty-ratio change rate till the commanded duty ratio reaches a predetermined duty ratio and to increase at a second duty-ratio change rate greater than the first duty-ratio change rate after the predetermined duty ratio is reached. In this case, the commanded duty ratio is increased at the relatively small first duty-ratio change rate till the commanded duty ratio sent out of the purge air increasing means to the purge regulating means reaches the predetermined duty ratio. That is, if the fuel evaporative emission suppressing system including the purge regulating means is normal, the purge-air introduction amount is gradually increased. Thus, torque fluctuation or insufficient combustion caused by the supply of overrich mixture attributable to purge air introduction can be relaxed. After the commanded duty ratio reaches the predetermined duty ratio, the commanded duty ratio is increased at the second change rate greater than the first duty-ratio change rate. That is, if the fuel evaporative emission suppressing system including the purge regulating means is normal, the purge air introduction is promoted, and fault diagnosis is made securely and rapidly. As a result, fault diagnosis can be made securely and rapidly while relaxing torque fluctuation or insufficient combustion caused by the supply of overrich mixture, etc.

More preferably, the diagnosing means repeats fault diagnosis of the fuel evaporative emission suppressing system as long as the variation of the operating state information quantity observed from the moment when the purge-air increasing means started control of the purge regulating means is less than a predetermined decision reference value, and concludes that the fuel evaporative emission suppressing system is normal if the variation of the operating state information quantity exceeds the decision reference value. In this case, the fuel evaporative emission suppressing system is concluded as being normal when the variation of the operating state information quantity observed from the moment when the purge-air increasing means started control of the purge regulating means exceeds the predetermined decision reference value. As a result, a possibility to misdiagnose the system as being faulty is reduced.

Preferably, the diagnosing means concludes that the fuel evaporative emission suppressing system is faulty if the variation of the operating state information quantity observed from the moment when the purge-air increasing means started sending out of the commanded duty ratio to the purge regulating means to the moment when the commanded duty ratio is increased up to the predetermined upper limit of the duty ratio is less than a predetermined decision reference value. In this case, when the commanded duty ratio sent out of the purge-air increasing means to the purge regulating means reaches the predetermined upper limit of the duty ratio, the variation of the operating state information quantity till that time is judged. If the fuel evaporative emission suppressing system including the purge regulating means is normal, a sufficient amount of purge air has been already introduced by that time and a significant change has already taken place in the engine operating state. Thus, if the variation of the operating information quantity till the moment when the commanded duty ratio reaches the upper-limit duty ratio is less than the decision reference value, the fuel evaporative emission suppressing means is concluded as being faulty. As a result, a possibility to misdiagnose the device as being faulty at a transitional stage of the purge air introduction is reduced.

In the above-mentioned two preferred embodiments in which the increasing degree of change rate of the purge-air introduction amount is changed according to the commanded operation quantity or the elapsed time period, preferably, the engine is controlled by an engine controlling means. The engine controlling means comprises an air-fuel ratio detecting means for detecting an air-fuel ratio of an air-fuel mixture supplied to the engine, a control correction quantity setting means for setting, based on a detection result obtained by the air-fuel ratio detecting means, a control correction quantity for feedback control to control the air-fuel ratio of the mixture to a predetermined target air-fuel ratio, a fuel supply amount regulating means for regulating an amount of fuel supplied to the engine, and a fuel controlling means for drivingly controlling the fuel supply amount regulating means based on the control correction quantity set by the control correction quantity setting means. The operating state detecting means detects the control correction quantity set by the control correction quantity setting means as the operating state information quantity. In this case, if the fuel evaporative emission suppressing system including the purge air regulating means is normal and the purge air is introduced, the air-fuel ratio of the entire mixture fluctuates according to the air-fuel ratio of the purge air, and hence the control correction quantity set by the control correction quantity setting means is changed from that set for an ordinary case where no purge air introduction is carried out. Then, based on the control correction quantity detected as the operating state information quantity by the operating state detecting means, the diagnosing device executes fault diagnosis of the fuel evaporative emission suppressing system. That is, if the control correction quantity is changed while the purge regulating means is controlled by the purge-air increasing means, the system is concluded as being normal, whereas if the control correction quantity is not changed, the device is concluded as being faulty. As a result, the purge system is accurately concluded as being normal when the air-fuel ratio of the introduced purge air is richer or leaner than a predetermined value.

In the above-mentioned two preferred embodiments, preferably, the engine is controlled by the engine controlling means. The engine controlling means comprises an intake air regulating means for regulating an amount of air sucked into the engine through the intake passage so that an idling speed of the engine is maintained almost constant. The operating state change detecting means detects an operation quantity of the intake air regulating means as the operating state information quantity. In this case, if the fuel evaporative emission suppressing system including the purge regulating means is normal and the purge air is introduced during idling operation of the engine, the amount of air sucked into the engine is increased by the purge air introduction. At this time, the intake air regulating means operates to suppress the increase of the sucked air amount. Thus, based on the operation quantity of the intake air regulating means detected by the operating state detecting means as the operating state information quantity, the diagnosing means executes fault diagnosis of the fuel evaporative emission suppressing system. That is, the system is concluded as being normal if the operation quantity of the intake air regulating means changes while the purge regulating means is controlled by the purge-air increasing means, whereas the system is concluded as being faulty if the operation quantity does not change. As a result, if the purge air is introduced even in a small amount, a diagnosis that the purge system is normal can be made accurately.

In the aforementioned two preferred embodiments, preferably, the operating state change detecting means detects the rotational speed of the engine as the operating state information quantity. In this case, if the fuel evaporative emission suppressing system including the purge regulating means is normal and the purge air is introduced, the engine speed is changed by the introduction of purge air. Thus, based on the engine speed detected by the operating state detecting means as the operating state information quantity, the diagnosing means executes fault diagnosis of the fuel evaporative emission suppressing system. That is, if the engine speed changes while the purge regulating means is controlled by the purge-air increasing means, the system is concluded as being normal, whereas if the engine speed does not change, the system is concluded as being faulty. Thus, a diagnosis that the purge system is normal can be accurately made if the engine speed is changed to some extent by introduction of purge air.

These and other objects and advantages will become more readily apparent from an understanding of the preferred embodiments described below with reference to the following drawing figures.

BRIEF DESCRIPTION OF THE DRAWINGS

The invention will become more fully understood from the detailed description given herein below with reference to the accompanying figures, given by way of illustration only and not intended to limit the present invention in which.

DETAILED DESCRIPTION OF THE PREFERRED EMBODIMENTS

Figure 1:
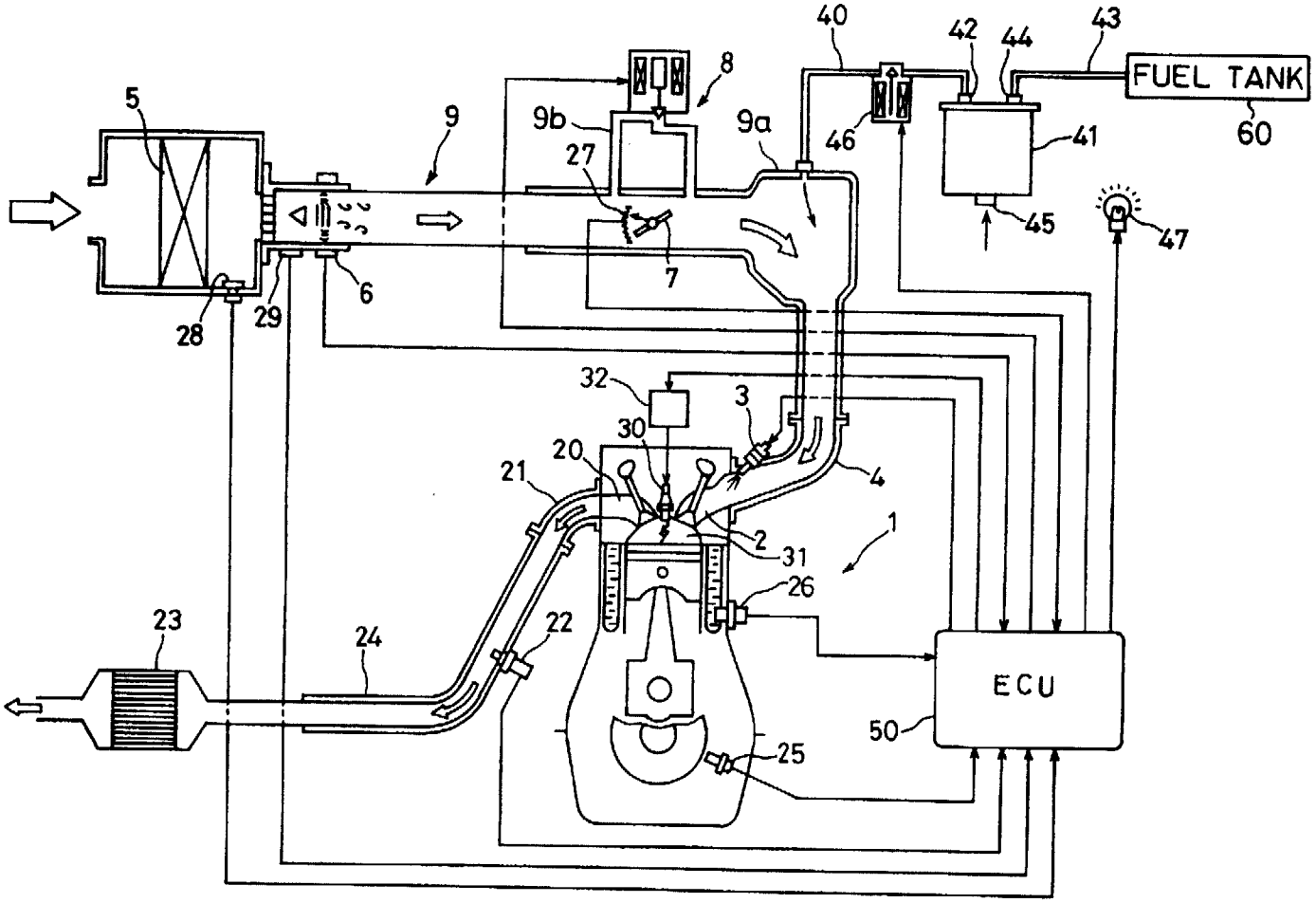
FIG. 1 is a schematic view showing an engine control system to which a fault diagnosis apparatus according to an embodiment of the present invention is applied.

Referring now to FIG. 1, a fault diagnosis apparatus according to an embodiment of the present invention, which is provided in a fuel evaporative emission suppressing system attached to an engine, will be described in detail.

In FIG. 1, reference numeral 1 denotes an automotive engine, e.g., a four-cylinder in-line gasoline engine. An intake manifold 4 is connected to intake ports 2 of the engine 1, and is provided with fuel injection valves 3 for respective cylinders. An intake pipe 9, which is connected to the intake manifold 4 through a surge tank 9a for intake pulsation prevention, is provided with an air cleaner 5 and a throttle valve 7. A bypass line 9b for by-passing the throttle valve 7 is provided with an idling speed control valve 8 for regulating the amount of air sucked into the engine 1 through the bypass line 9b. The idling speed control valve 8 includes a valve plug for increasing or reducing the flow area of the bypass line 9b, and a stepping motor for driving the valve plug to cause the same to open and close.

An exhaust manifold 21 is connected to exhaust ports 20 of the engine 1, and a muffler (not shown) is connected to the manifold 21 through an exhaust pipe 24 and a three-way catalyst 23. Numerals 30 and 32 denote spark plugs for igniting air-fuel mixture fed into combustion chambers 31 through the intake ports 2, and an ignition unit connected to the plugs 30, respectively.

Further, the engine 1 is furnished with a fuel evaporative emission suppressing system (purge system) for preventing the emission of a fuel evaporative gas produced in a fuel tank 60 (fuel supply system in general).

The fuel evaporative emission suppressing system includes a canister 41 loaded with activated charcoal which adsorbs the fuel evaporative gas. The canister 41 is formed with a purge port 42, which communicates with the surge tank 9a of the engine 1 by means of a purge pipe (purge passage) 40, an inlet port 44, which communicates with the fuel tank 60 by means of an inlet pipe 43, and a vent port 45 which opens into the atmosphere. The purge pipe 40 is provided with a purge control valve (PCV) 46.

The PCV 46 is composed of a normally-open solenoid valve which includes a valve plug for opening and closing the purge pipe 40, a spring for urging this plug in the valve closing direction, and a solenoid which is connected electrically to an electronic control unit (ECU) 50. The PCV 46, which is turned on and off by means of the ECU 50, opens when its solenoid is de-energized, and closes when the solenoid is energized. When the PCV 46 is open, an intake negative pressure acts on the purge port 42, and atmospheric air flows into the canister 41 through the vent port 45. As the atmospheric air is introduced in this manner, the fuel component of the fuel evaporative gas, having so far been adsorbed by the canister 41, leaves the canister 31, and as purge air, flows together with the atmospheric air into the surge tank 9a. When the PCV 46 is closed, on the other hand, the introduction of the purge air is prevented. That is, the ECU 50 functions as a purge increasing means for controlling the PCV 46 which serves as a purge regulating valve of a purge regulating means for regulating the introduction amount of the purge air.

The fuel evaporative emission suppressing system is furnished with a fault diagnosis apparatus which includes operating state detecting means for detecting an operating state of at least one of the vehicle, engine 1, and means for controlling the engine 1. The operating state detecting means includes various sensors, which will be described below, and most of the sensors are also used for ordinary engine operation control.

In FIG. 1, numeral 6 denotes an airflow sensor of the Karman-vortex type attached to the intake pipe 9 and used to detect the quantity of intake air; 22, an $O_2$ sensor (air-fuel ratio detecting means) for detecting the oxygen concentration of exhaust gas flowing in the exhaust pipe 24; and 25, a crank angle sensor which, including an encoder drivingly coupled to a camshaft of the engine 1, generates crank angle synchronous signals. Numerals 26 and 27 denote a water temperature sensor for detecting an engine cooling water temperature TW and a throttle sensor for detecting an opening degree $\theta_{TH}$ of a throttle valve 7, respectively. Further, numerals 28 and 29 denote an atmospheric pressure sensor for detecting the atmospheric pressure Pa, and an intake air temperature sensor for detecting an intake air temperature Ta, respectively.

The fault diagnosis apparatus includes a fault diagnosing means which checks the fuel evaporative emission suppressing system for a fault in accordance with changes in the operating state detected by means of the sensors 6, 22, and 25 to 29. The fault diagnosing means is constituted by the ECU 50.

The ECU 50 includes input and output devices, memories (ROM, RAM, nonvolatile RAM, etc.) stored with various control programs and the like, central processing unit (CPU), timer, etc., none of which are shown. The sensors 6, 22 and 25 to 29 are connected electrically to the input side of the ECU 50, while the stepping motor of the idling speed control valve 8, the solenoid of the PCV 46, a warning lamp 47 are connected electrically to the output side of the ECU 50. The warning lamp 47 is attached to an instrument panel of the vehicle and serves to warn a driver of a fault in the PCV 46.

The ECU 50 calculates an engine rotational speed NE according to the generation time interval of the crank angle synchronous signals delivered from the crank angle sensor 25. Thus, the ECU 50, in conjunction with the crank angle sensor 25, constitutes an engine speed detecting means. Also, the ECU 50 calculates an intake air amount (A/N) for each intake stroke according to the engine speed and the output of the airflow sensor 6, and detects the change in the operating state of the engine 1 in accordance with the calculated engine speed $N_E$, calculated intake air quantity (A/N), oxygen concentration of the exhaust gas detected by the $O_2$ sensor 22, etc.

The ECU 50 (fuel controlling means) controls the quantity of fuel injection from the fuel injection valve (fuel supply regulating means) 3 into the engine 1 in accordance with the engine operating state detected in the aforesaid manner. In the fuel injection quantity control, the ECU 50 computes a valve-opening time $T_{INJ}$ of each fuel injection valve 3 according to the following equation, supplies the fuel injection valve 3 with a driving signal corresponding to the computed valve-opening time $T_{INJ}$, thereby causing the valve 3 to open, and supplies the cylinder with a required quantity of fuel.

$$T_{INJ}=T_B\times K_{AF}\times K+T_{DEAD}$$

where K is the product ($K=K_{WT}\cdot K_{AT}\cdot\ \cdot\ \cdot$) of correction factors, such as a water temperature correction factor $K_{WT}$, intake air temperature correction factor $K_{AT}$, etc.; $K_{AF}$ is an air-fuel ratio correction factor; and $T_{DEAD}$ is a dead time correction value which is set in accordance with the battery voltage and the like.

In a case where the engine 1 is operated in an air-fuel ratio feedback area, the ECU 50 computes a feedback correction factor $K_{FB}$ as the air-fuel ratio correction factor $K_{AF}$ as follows:

$$K_{FB}=1.0+P+I+I_{LRN}$$

where P, I and $I_{LRN}$ are a proportional correction value, integral term, and learning correction value, respectively.

That is, the ECU 50 functions as a control correction quantity setting means for setting the control correction quantity (integral term I) for air-fuel ratio feedback control based on the air-fuel ratio of the mixture detected by the air-fuel ratio detecting means ($O_2$ sensor 22). And the ECU 50 as the fuel controlling means drivingly controls the fuel injection valves 3 according to the control correction quantity.

Moreover, the ECU 50 controls the opening degree of the idling speed control valve 8 by drivingly controlling the stepping motor of the idling speed control valve 8 in accordance with the engine operating state. In this case, the ECU 50 calculates a deviation of the engine speed from a target engine speed, and executes feedback control of the valve opening degree so that the deviation is kept within a predetermined range, and maintains the engine idling speed almost constant. That is, the ECU 50 functions, in conjunction with the idling speed controller 8, as an intake air regulating means for regulating the intake air amount so that the idling speed is kept almost constant.

Referring now to FIGS. 2 to 7 and FIGS. 8 to 10, the operation of the fault diagnosis apparatus with the aforementioned construction will be described.

Figure 2:
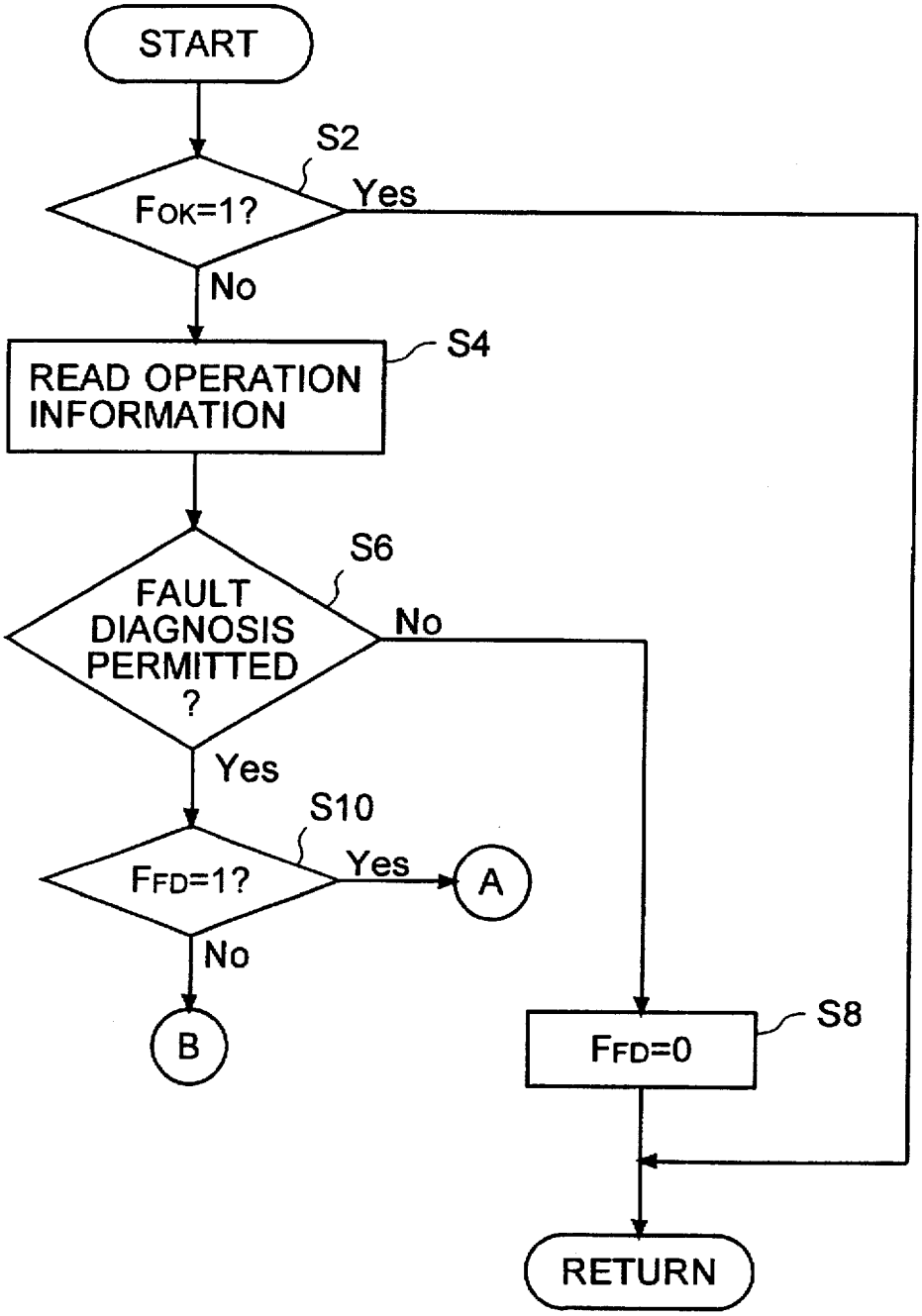
FIG. 2 is a flowchart showing part of a fault diagnosis subroutine executed by an engine control unit (ECU) shown in FIG. 1.
Figure 3:
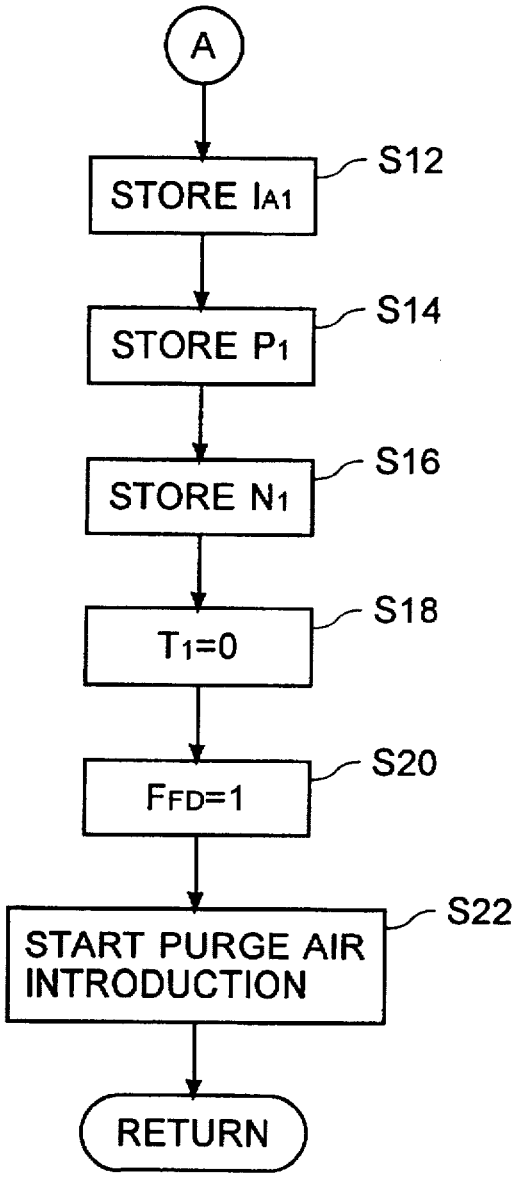
FIG. 3 is a flowchart showing another part of the fault diagnosis subroutine continued from FIG. 2.
Figure 4:
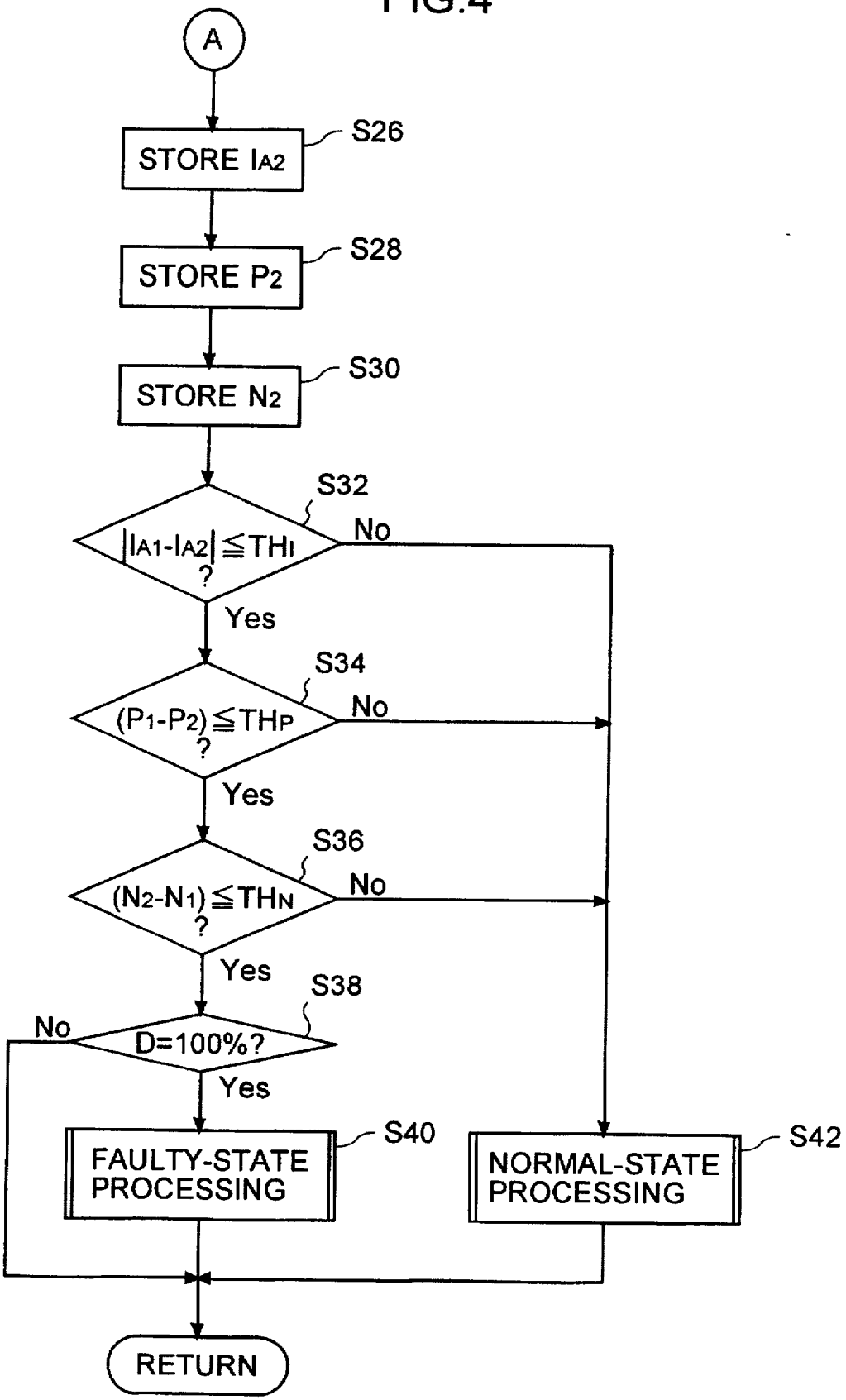
FIG. 4 is a flowchart showing the remainder of the fault diagnosis subroutine continued from FIG. 2.

When the driver turns on an ignition key to start the engine 1, the ECU (diagnosing means) starts to execute the fault diagnosis subroutine shown in FIGS. 2 to 4. This subroutine is repeatedly executed at a predetermined control interval. At the start of the fault diagnosis subroutine, a timer for measuring the time period having elapsed from the start of the engine is started.

In the fault diagnosis subroutine, it is first determined whether or not the value of a flag $F_{OK}$ is "1" which is indicative of a normal operation of the PCV 46 (Step S2). Immediately after the subroutine is started, a fault diagnosis on the PCV 46 in the subroutine is not executed yet, and hence it is unknown whether or not the PCV 46 is operating normally. Immediately after the start of the subroutine, therefore, the flag $F_{OK}$ is set at an initial value "0". Thus, the decision in Step S2 in a first subroutine execution cycle (control cycle) is negative (No), whereupon the control flow advances to Step S4.

In Step S4, outputs of the various sensors such as the water temperature sensor 26, the throttle sensor 27, etc. are read as pieces of operation information (operation information quantities) by the ECU 50 and stored in the RAM of the ECU 50.

In the next Step S6, it is determined whether or not fault diagnosis execution conditions are met by the current operating state. The fault diagnosis execution conditions include, for example, a first condition that a predetermined time period (e.g., 180 seconds) has elapsed from the start of the engine operation, a second condition that air-fuel ratio feedback control based on the output of the $O_2$ sensor 22 is started, a third condition that idling speed feedback control is being executed by the idling speed control valve 8, a fourth condition that the water temperature TW is not lower than a predetermined value (e.g., 82° C.), and a fifth condition that idle operation is being performed. The fault diagnosis execution conditions are fulfilled only when all of the first to fifth conditions are fulfilled simultaneously.

The decision in Step S6 in the first control cycle is No, because the predetermined time period has not elapsed yet from the start of the engine operation. In this case, it is concluded that the fault diagnosis execution conditions are not met, and the control flow advances to Step S8. In Step S8, a flag $F_{FD}$ is set at "0" which indicates that no fault diagnosis is being executed. Thereupon, the execution of the subroutine in the present control cycle (first cycle in this case) terminates.

When a time period corresponding to a subroutine execution period (predetermined period) is up, thereafter, the fault diagnosis subroutine is rerun starting with Step S2. Unless the fault diagnosis execution conditions are met, Step S2, S4, S6 and S8 are executed repeatedly. While this is done, the ECU 50 can execute a conventional purge control subroutine (not mentioned herein) in parallel with the fault diagnosis subroutine shown in FIGS. 2 to 4. In this case, the PCV 46 is drivingly controlled as required by the ECU 50, and ordinary purge air introduction, not purge air introduction for fault diagnosis, is carried out, if necessary.

Figure 8:
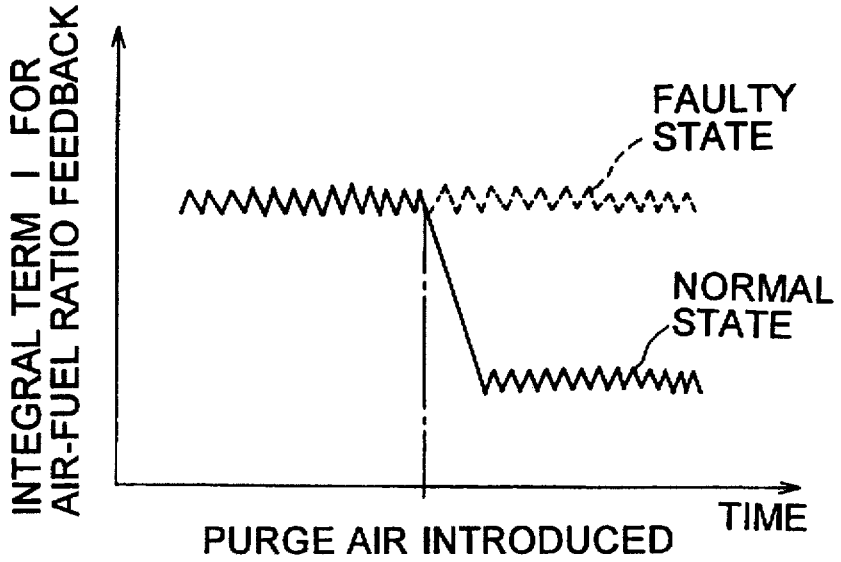
FIG. 8 is a graph showing a change in an integral term for air-fuel ratio feedback before and after the introduction of purge air.

If it is concluded in Step S6 that the fault diagnosis execution conditions are met by the current operating conditions, thereafter, the control flow advances to Step S10 wherein it is determined whether or not the value of the flag $F_{FD}$ is "1" which indicates that the fault diagnosis is being executed. Immediately after the fault diagnosis execution conditions are fulfilled, the flag $F_{FD}$ remains at the initial value "0", so the decision in Step S10 is No. In this case, the control flow advances to Step S12 of FIG. 3. In Step S12, the current integral term I for the air-fuel ratio feedback control before the purge air introduction (PCV driving) is read a plurality of times at a predetermined time interval. As mentioned before, the integral term I is a control correction quantity used in calculating the feedback correction factor $K_{FB}$. During the air-fuel ratio feedback control, the integral term I continually increases or decreases depending on the output voltage of the $O_2$ sensor 22, as shown in FIG. 8. Subsequently, an average $I_{AVE}$ of the read values of the integral term I which have been read a plurality of times is calculated, and the resulting value is stored as a first integral value $I_{A1}$ in the RAM.

In the next Step S14, the current opening value of the idling speed controller valve 8 or a valve position $P_V$ is read, and is stored as a first position $P_1$ in the RAM. The ECU 50 (operation quantity detecting means) has a storage region in its RAM which renewably stores the number of driving pulses delivered from the ECU 50 to the stepping motor of the idling speed controller 8. The stored driving pulse number increases every time a driving pulse to drive the valve 8 in the opening direction is delivered, and decreases every time a driving pulse to drive the valve 8 in the closing direction is delivered. Thus, the driving pulse number represents the current position of the idling speed controller valve 8 (operation quantity of the intake air regulating means). In Step S16, the current engine speed $N_E$ is calculated, and the resulting value is stored as a first speed $N_1$ in the RAM. Before the PCV is driven (or the purge air is introduced), the value of the valve position $P_V$ is relatively large, and the engine speed $N_E$ is relatively low.

In Step S18, a timer to measure a time period $T_1$ having elapsed from the start of purge air introduction is restarted. That is, after the count value of the timer is rest at "0", the timer is started. In the next Step S20, the flag $F_{FD}$ is set at "1" which indicates that the fault diagnosis is being executed. In Step S22, the PCV 46 is energized. As a result, the purge air introduction for fault diagnosis is usually started. Thereupon, the execution of the fault diagnosis subroutine in the control cycle concerned terminates.

Since the decision in Step S10 is Yes in the next control cycle, the control flow advances to Step S26 of FIG. 4. In Step S26, the current integral term I for the air-fuel ratio feedback control after the PCV 46 is driven (or the purge air is introduced) is read a plurality of times at a predetermined time interval, and the average $I_{AVE}$ of the read values of the integral term I is calculated and stored as a second integral value $I_{A2}$ in the RAM. In the next Step S28, the current valve position $P_V$ of the idling speed controller 8 is stored as a second position $P_2$ in the RAM. In Step S30, the current engine speed $N_E$ is stored as a second speed $N_2$ in the RAM.

Figure 9:
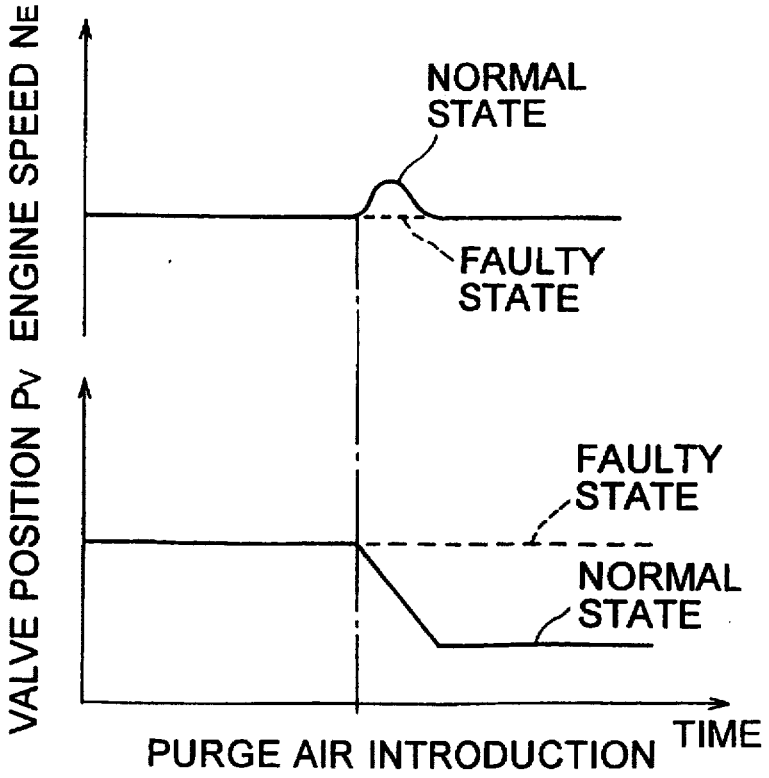
FIG. 9 is a graph showing changes in engine speed and valve position of an idling speed controller before and after the introduction of purge air.

The air-fuel ratio of the purge air introduced for the fault diagnosis varies depending on the quantity of the fuel evaporative gas adsorbed by the canister 41, etc. The value of the integral term I decreases if the air-fuel ratio of the purge air is richer than the theoretical or stoichiometric air-fuel ratio, and increases if the air-fuel ratio is leaner than that. After the purge air introduction, the value of the valve position $P_V$ is reduced by a margin corresponding to the amount of the introduced purge air, as shown in FIG. 9. The engine speed $N_E$ temporarily increases from a predetermined idling speed, and thereafter as the purge air is introduced, is restored to the predetermined value by the idling speed feedback control by means of the idling speed controller valve 8.

If a fault in the PCV 46 prevents the purge air introduction, the value of the integral term I makes no substantial change (indicated by broken line in FIG. 8), and neither of the valve position $P_V$ nor the engine speed $N_E$ changes (indicated by broken lines in FIG. 9). For the convenience of explanation, FIGS. 8 and 9 show the case where the PCV 46 is fully opened to allow the maximum introduction of the purge air.

In Step S32, the absolute value ($|I_{A1}-I_{A2}|$) of the difference between the first and second integral values $I_{A1}$ and $I_{A2}$ is calculated, and it is then determined whether or not this absolute value is smaller than a predetermined threshold value $TH_I$.

The absolute value of the integral value deviation becomes significant in a case where rich or lean purge air is introduced normally. If no purge air is introduced due to a fault in the PCV 46, on the other hand, the absolute value of the deviation becomes zero. In case that the air-fuel ratio of the purge air is very close to the theoretical air-fuel ratio, however, the value of the integral value I hardly varies despite the normal introduction of the purge air, so the integral value of the deviation becomes nearly zero. Thus, if the air-fuel ratio of the purge air is approximate to the theoretical air-fuel ratio, it is inappropriate to make a definite fault diagnosis in accordance with the integral value of the deviation.

Thus, according to the present embodiment, even if the decision in Step S32 is Yes, that is, even if the result of the diagnosis based on the change in the air-fuel ratio which is attributable to the operation of the PCV 46 represents an occurrence of fault, it is not definitely concluded that the fault has occurred, and the fault diagnosis is further executed in accordance with the change in the operation quantity of the idling speed controller valve 8, which is caused when the PCV 46 is driven (or when the purge air is introduced), and the change in the engine speed.

Thus, in Step S34, a difference ($P_1-P_2$) between the first and second positions $P_1$ and $P_2$ is calculated, and it is determined whether or not the calculated deviation is smaller than a predetermined threshold value $TH_P$. If the decision in Step S34 is Yes, a difference ($N_2-N_1$) between the second and first engine speeds $N_2$ and $N_1$ is calculated, and it is further determined whether or not the calculated deviation is smaller than a predetermined threshold value $TH_N$ in Step S36.

If the decisions in Steps S32, S34 and S36 are all Yes, that is, if no substantial change in the operating state attributable to the purge air introduction is detected even though the PCV 46 is driven in Step S22, the purge air introduction for fault diagnosis has not been executed, and there is a possibility that a fault has occurred in the purge system. If the purge air introduction is not sufficient yet, however, the operating state makes no substantial change even if the purge system is normal. Then, the ECU 50 determines in Step S38 whether or not the driving duty ratio "D" of the PCV 46 is a predetermined upper limit duty ratio (100%, for example), to thereby makes a determination as to whether or not a sufficient amount of the purge air has been introduced. If the decision in Step S38 is No, the control flow returns to START.

After that, while the fault diagnosis conditions are met, a series of steps including S2 to S10 and S26 to S38 are executed repeatedly as long as the duty ratio does not reach 100%. That is, the faulty decision is not made before the PCV 46 is fully opened even if no substantial change is detected in the operating state caused by the operation of the PCV 46. By this, erroneous diagnosis during the purge air introduction process can be prevented.

If the fault diagnosis execution conditions ceased to be met during the execution of fault diagnosis, the control flow advances to Step S8. That is, execution of fault diagnosis is interrupted. In this case, another fault diagnosis is started when the fault diagnosis execution conditions are fulfilled again, thereafter.

If the decisions in Steps S32, S34 and S36 are all Yes and the decision in Step S38 is also Yes, the ECU 50 judges that the purge system is faulty and executes a faulty-state processing subroutine in Step S40.

Figure 5:
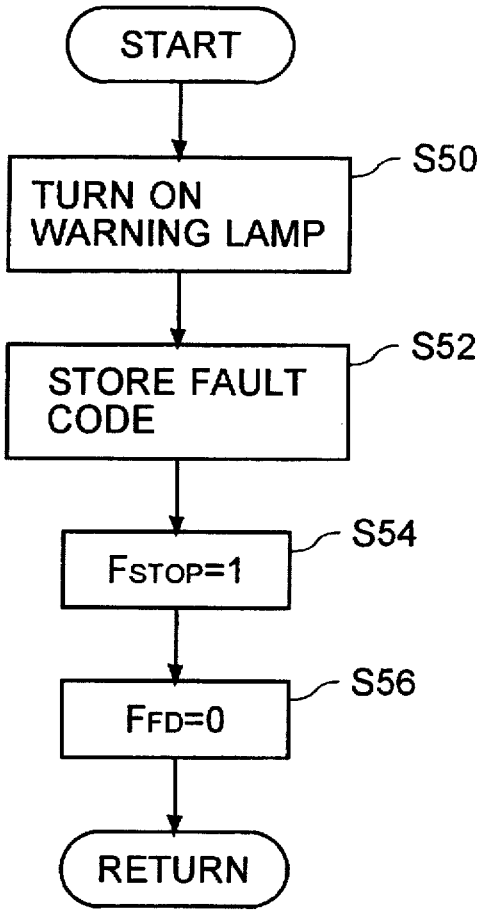
FIG. 5 is a flowchart showing a faulty-state processing subroutine executed in the fault diagnosis subroutine.

In the faulty-state processing subroutine, as is shown in detail in FIG. 5, the warning lamp 47 is turned on in Step S50, thereby giving the driver warning. In the next Step S52, a fault code for diagnosis is stored in the nonvolatile RAM. In Step S54, moreover, the value of a flag $F_{STOP}$ which is referred to in a purge-air introduction control subroutine (FIG. 7), which will be described later, is set at "1". As a result, as mentioned later, the PCV 46 is de-energized in the purge-air introduction control subroutine, whereupon the purge air introduction for fault diagnosis is interrupted. Then, in Step S56, the flag $F_{FD}$ is reset at "0" which indicates that no fault diagnosis is being executed. Thereupon, the execution of the fault diagnosis subroutine in the control cycle concerned terminates.

If the fault in the purge system is a temporary one, the purge system is returned to its normal state even after it is concluded to be faulty. Even when the purge system is once concluded to be faulty, therefore, the fault diagnosis is rerun in the fault diagnosis subroutine shown in FIGS. 2 to 4.

If a change in the operating state attributable to the purge air introduction for fault diagnosis is detected, that is, if any of the decisions in Steps S32, S34 and S36 is No, a normal-state processing subroutine is executed in Step S40.

Figure 6:
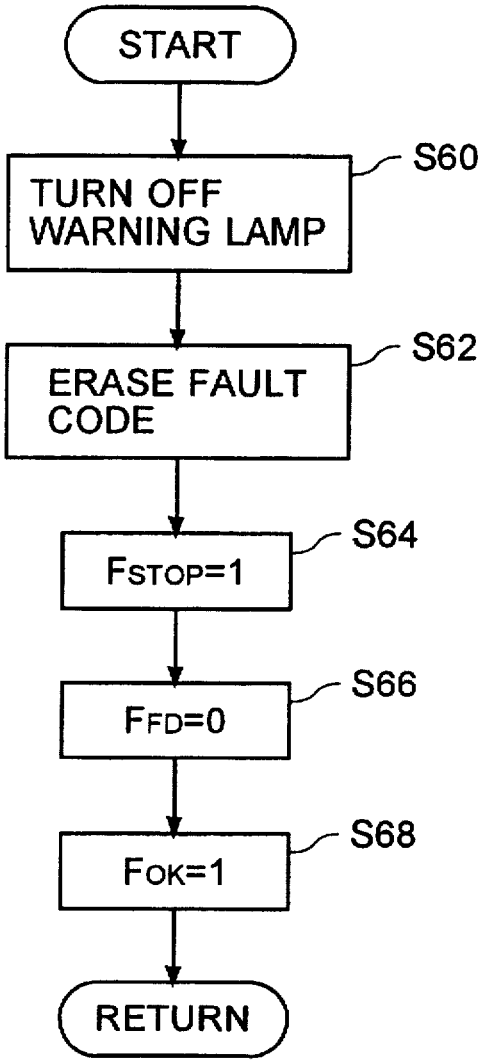
FIG. 6 is a flowchart showing a normal-state processing subroutine executed in the fault diagnosis subroutine.

In the normal-state processing subroutine, as is shown in detail in FIG. 6, the warning lamp 47 is turned off in Step S60, and the fault code for diagnosis is erased from the nonvolatile RAM in Step S62. In the next Step S64, the value of the flag $F_{STOP}$ is set at "1". As a result, the PCV 46 is de-energized in the purge-air introduction control subroutine, and the purge air introduction for fault diagnosis is interrupted. Then, in Step S66, the value of a second flag $F_{FD}$ is reset at "0" which indicates that no fault diagnosis is being executed. In Step S68, thereafter, the flag $F_{OK}$ is set at "1" which indicates that the purge system is normal. Once the purge system is thus concluded to be normal, the decision in Step S2 in the fault diagnosis subroutine shown in FIGS. 2 to 4 is Yes, so the execution of this subroutine terminates immediately, that is, no substantial processing is carried out. If the ignition key is turned on after it is once turned off, however, substantial processing in the fault diagnosis subroutine is executed again.

Next, the purge-air introduction control subroutine (FIG. 7) executed during fault diagnosis in parallel with the fault diagnosis subroutine in FIGS. 2 to 4 will be hereinbelow explained.

In the purge-air introduction control subroutine of this preferred embodiment, the entire PCV driving period (purge air introduction period) is divided into a first half and second half, and the PCV driving duty ratio "D" is increased by a relatively small increment in the first half, while it is increased by a relatively large increment in the second half. The PCV (purge regulating means) 46 is opened and closed according to the duty ratio "D" sent out of the ECU (purge-air increasing means) 50 as a commanded duty ratio (commanded operation quantity).

Figure 7:
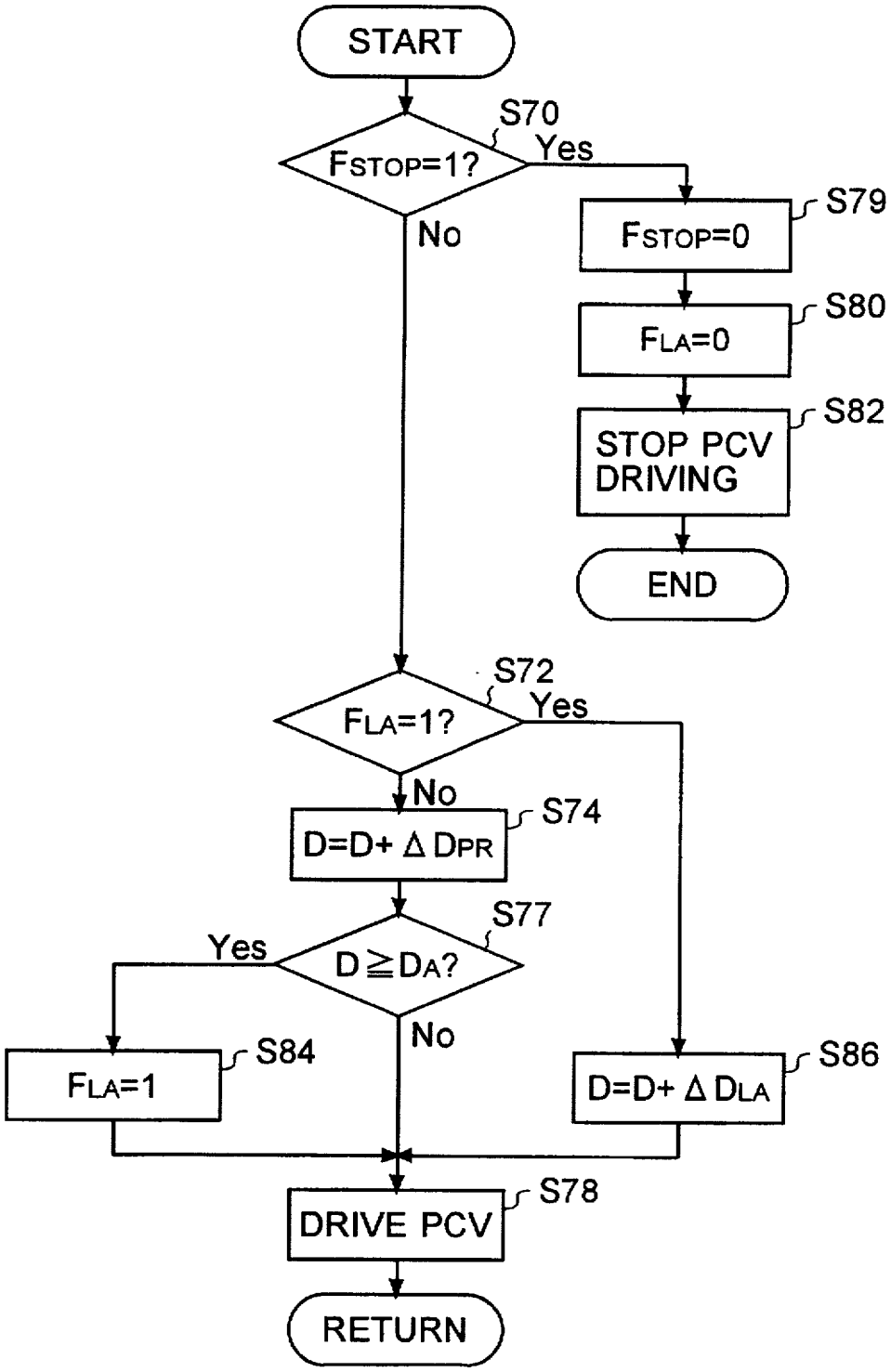
FIG. 7 is a flowchart showing a purge-air introduction control subroutine.

If start of driving of the PCV 46 is decided in Step S22 in FIG. 3, the ECU 50 starts the purge-air introduction control subroutine shown in FIG. 7, and first determines in Step S70 whether or not the flag $F_{STOP}$ is "1" which indicates that the purge air introduction has been interrupted. Immediately after the start of the subroutine, the decision in Step S70 is naturally No, and the ECU 50 determines in Step S72 whether or not a flag $F_{LA}$ is "1" which indicates the second half of the PCV driving period. As the initial value of the flag $F_{LA}$ is set at "0", immediately after the start of this subroutine, the decision in Step S72 is No. In this case, the ECU 50 renews the duty ratio "D" in Step S74 by adding an increment for the first half $\Delta D_{PR}$ (1% in this embodiment) to the driving duty ratio "D" (here, the initial value "0"), and determines in Step S76 whether or not the renewed driving duty ratio "D" has reached a predetermined threshold value $D_A$ (30% in this embodiment). If this decision is also No, the PCV 46 is driven in Step S78 according to the duty ratio renewed in Step S74. Whereupon, execution of this subroutine in the control cycle concerned terminates.

Figure 10:
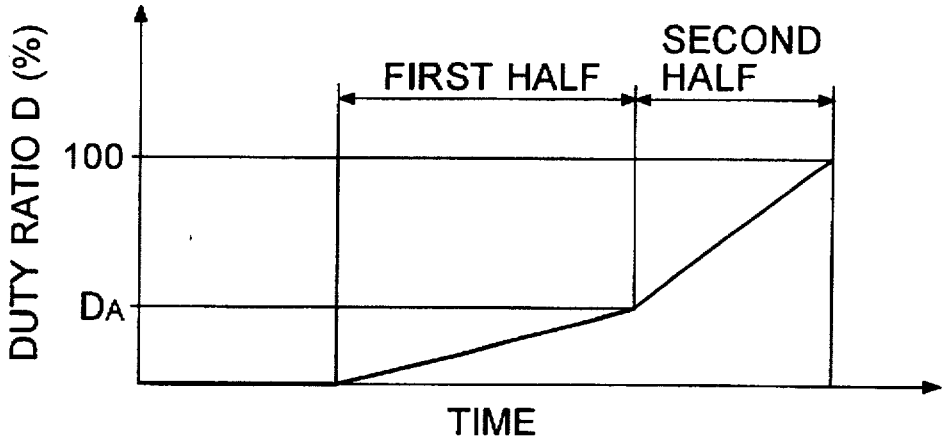
FIG. 10 is a graph showing a change in a driving duty ratio for a purge control valve (PCV)

Unless the value of the flag $F_{STOP}$ is set at "1" in the faulty-state processing subroutine shown in FIG. 5 or in the normal-state processing subroutine shown in FIG. 6, a series of Steps S70, S72, S74, S76 and S78 are repeatedly executed in the purge-air introduction control subroutine in FIG. 7. As a result, the driving duty ratio "D" for the PCV 46 is, as shown in FIG. 10, gradually increased at a first duty-ratio change rate which is equal to the value acquired by dividing the increment $\Delta D_{PR}$ by a subroutine execution cycle. Thus, the amount of the purge air introduced into the intake pipe 9 is gradually increased at a first change rate corresponding to the first duty-ratio change rate.

If any one of the decisions in Step S32, S34 or S36 in FIG. 4 is No due to some change in the operating state in the first half of the purge air introduction, the purge system is concluded to be normal. Then, the value of the purge-air introduction stop flag $F_{STOP}$ is set at "1" in the normal-state processing subroutine in FIG. 6. In this case, as the decision in Step S70 is Yes, the control flow advances to Step S79, wherein the value of the flag $F_{STOP}$ is reset at "0" which indicates interruption of the purge air introduction. Next, the ECU 50 resets the value of the flag $F_{LA}$ at "0," and then stops driving of the PCV 46 in Step S82 and terminates the purge-air introduction control subroutine. In the first half of the purge air introduction, as the flow rate of purge air and its increase rate is small, drivability of the engine 1 attributable to the purge air introduction hardly worsens. If the purge system is normal, some change in the operating state generally occurs before the end of the first half of the purge air introduction, so that the purge system is concluded to be normal.

If the driving duty ratio "D" reaches the decision threshold value $D_A$ without normality decision being made, on the other hand, the ECU 50 sets in Step S84 the value of the flag $F_{LA}$ at "1" which indicates the second half of the purge air introduction. As a result, the decision in Step S72 is Yes, and the ECU 50 renews the duty ratio "D" by adding an increment for the second half $\Delta D_{LA}$ (5% in this embodiment) to the driving duty ratio "D" in Step S86, and the PCV 46 is driven according to the renewed duty ratio "D" in Step S78. By this, the driving duty ratio "D" of the PCV 46 is relatively rapidly increased at a second duty-ratio change rate which is equal to the value acquired by dividing the increment $\Delta D_{LA}$ by the subroutine execution cycle, so that the amount of the purge air introduced into the intake pipe 9 is rapidly increased at the second change rate corresponding to the second duty-ratio change rate.

If some change in operating state occurs in the second half of the purge air introduction, the purge system is concluded to be normal, and the purge-air introduction stop flag $F_{STOP}$ and the second half introduction flag $F_{LA}$ are reset, and driving of the PCV 46 is stopped, as mentioned above (Steps S79, S80 and S82).

If no substantial change in the operating state occurs even after the driving duty ratio "D" reaches 100% (upper limit duty ratio), however, the decision in Step S38 in FIG. 4 is Yes, and the purge system is concluded as being faulty. In this case, the purge-air introduction stop flag $F_{STOP}$ is set at "1" in the faulty-state processing subroutine in FIG. 5. Further, the purge-air introduction stop flag $F_{STOP}$ and the second half introduction flag $F_{LA}$ are reset and driving of the PCV 46 is stopped in the purge-air introduction control subroutine in FIG. 7 (Step S79, S80 and S82).

The driving duty ratio "D" is larger in the second half of the purge-air introduction, but in many cases, ordinarily, no purge air is introduced because of a fault of the PCV 46 or clogging of piping, and there is little possibility that drivability, etc. might worsen due to excessive supply of the purge air.

In this embodiment, the fault diagnosis is made and the purge-air introduction for fault diagnosis is controlled in the aforementioned steps of procedure, so a fault in the purge system can be diagnosed accurately and quickly with little deterioration in drivability, and the fuel evaporative gas can be securely prevented from being discharged into the atmosphere. Further, a final fault diagnosis is made based on the difference between integral values for the air-fuel ratio feedback control, the difference between engine speeds, and the difference between the valve positions of the idling speed controller, the integral values, engine speeds and valve positions being obtained before and after the purge-air introduction, there is little possibility of making an erroneous diagnosis.

In the above, one preferred embodiment of this invention has been explained. The present invention is not limited to this embodiment. For example, the fault diagnosis of the PCV 46 in the preferred embodiment is made according to three operating states before and after the purge air introduction (control correction quantity (integral term I) for air-fuel ratio feedback control, engine speed, and operation quantity of the intake air regulating means (valve position of the controller 8)), but fault diagnosis can be made according to not more than two or not less than four operating states.

Figure 11:
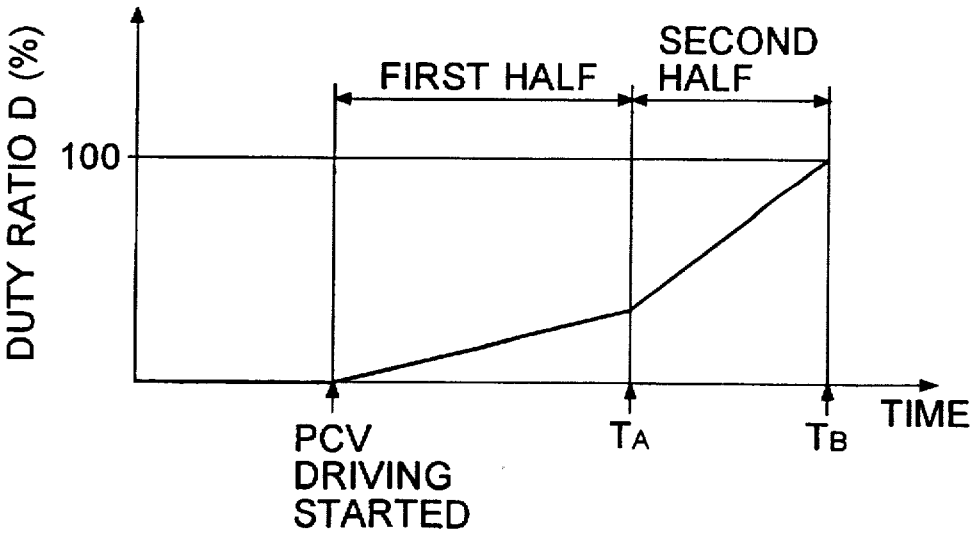
FIG. 11 is a graph showing a change in a duty ratio in a modification of the present invention.
Figure 12:
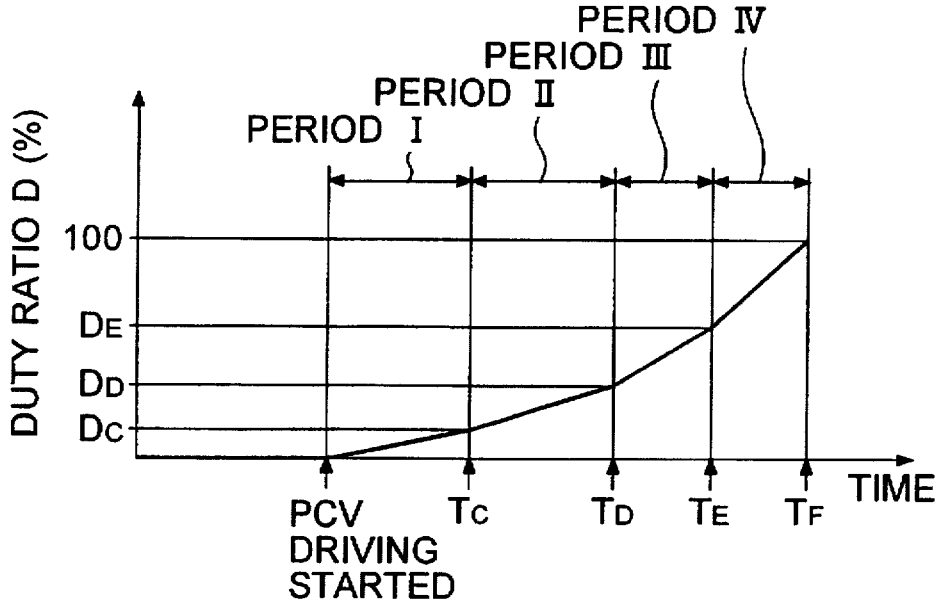
FIG. 12 is a graph showing a change in a duty ratio in anther modification of the present invention.

In the preferred embodiment, the entire PCV driving period (purge air introduction period) is divided into two periods of the first half where the duty-ratio change rate (purge air increment) is small and the second half where the duty-ratio change rate is large (FIG. 10), and transition from the first half to the second half is made when the duty ratio "D" reaches the threshold value $D_A$, but as shown in FIG. 11, the transition from the first half to the second half can be made when the time period having elapsed from the start of the PCV driving has reached a predetermined time period $T_A$. Further, the entire PCV driving period can be divided into more than three periods. FIG. 12 shows the case where the entire PCV driving period is divided into four periods of I, II, III and IV periods. In this case, the transition from the preceding period to the succeeding period is made every time when the duty ratio "D" reaches threshold values $D_C$, $D_D$, and $D_E$ or the elapsed time reaches predetermined time periods $T_C$, $T_D$ and $T_E$.

Figure 13:
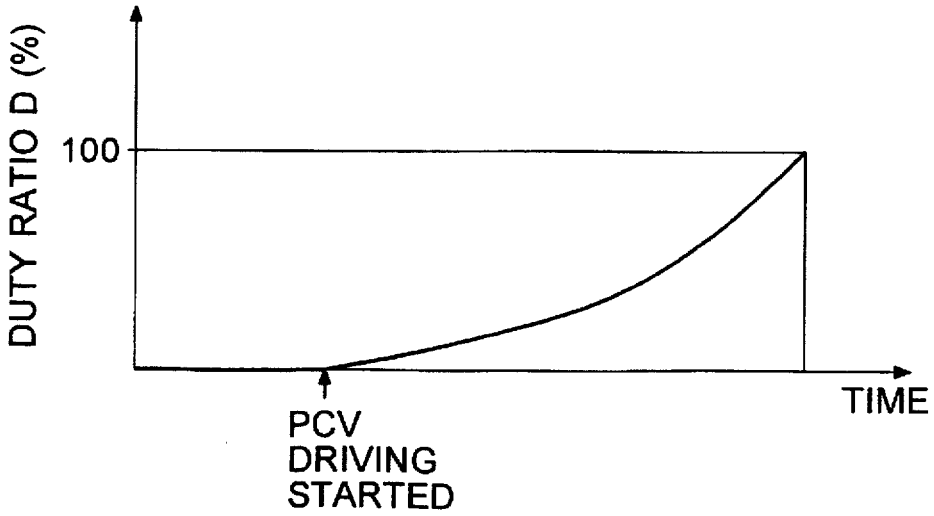
FIG. 13 is a graph showing a change in a duty ratio in still another modification of the present invention.

Moreover, in the preferred embodiment, the change rate of the PCV duty ratio is increased stepwise with elapse of time, but the change rate of the duty ratio (operation quantity of the purge regulating means) can be continuously increased with elapse of time. In the preferred embodiment, the duty ratio is changed linearly (at a constant change rate) in each of the first and second halves of the PCV driving period, but in this modification, the duty ratio "D" is increased non-linearly in accordance with a predetermined function (curve). FIG. 13 shows the case where the duty-ratio change rate is continuously increased according to a simple equation whose variable is the elapsed time from the start of PCV driving. In this case, the duty ratio "D" is increased along a quadratic curve whose variable is the elapsed time.

Even if the duty ratio is increased non-linearly, the entire PCV driving period can be divided into more than two periods based on the duty ratio or the elapsed time. In this case, the duty ratio is increased according to different functions in the respective periods.

Figure 14:
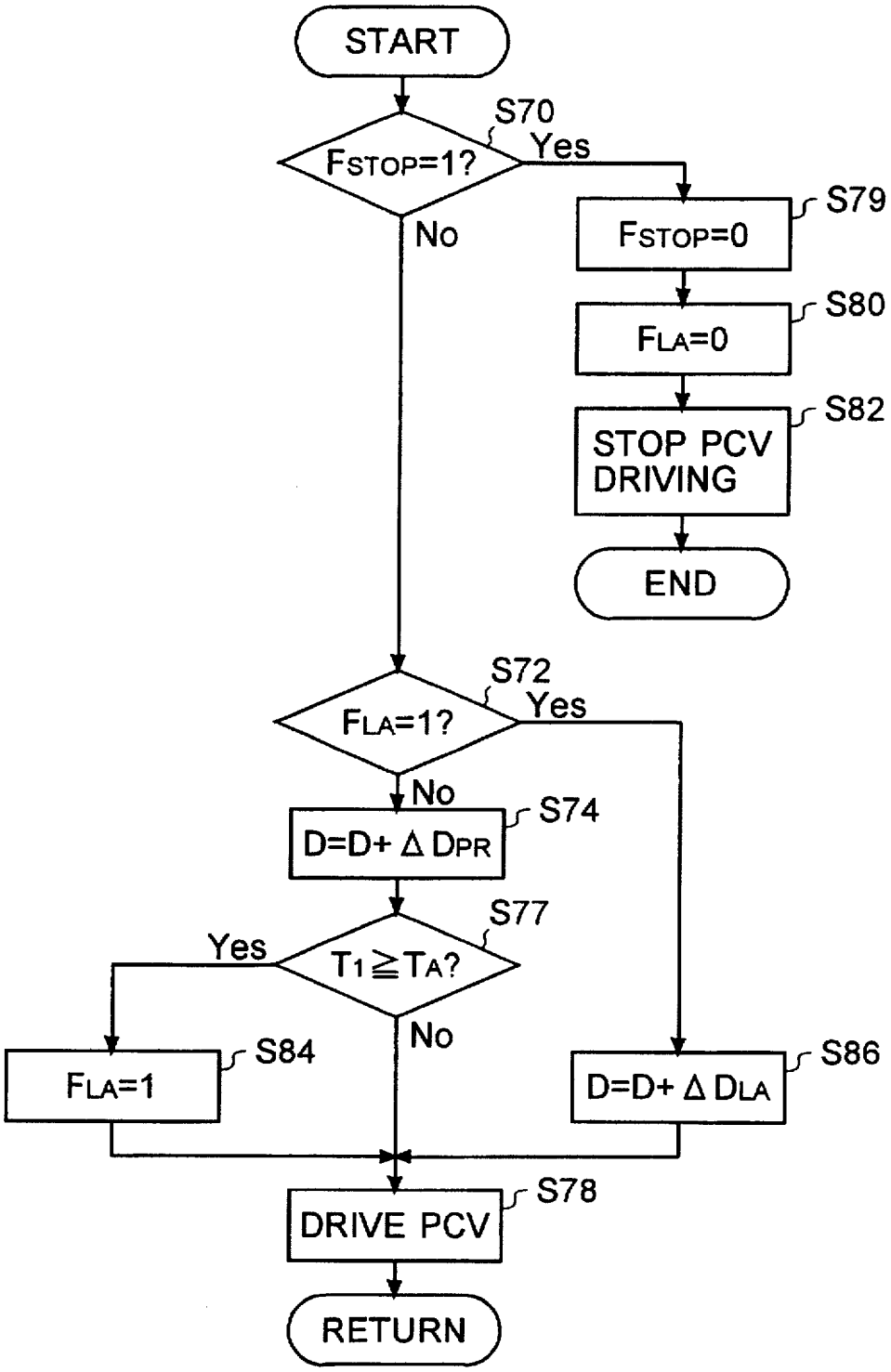
FIG. 14 is a flowchart showing a purge-air introduction control subroutine in the modification shown in FIG. 11.

In case that the increasing degree of the purge-air introduction amount is increased by effecting transition from the first half to the second half at the moment when the elapsed time from the start of the PCV driving reaches a predetermined time period $T_A$, as shown in FIG. 11, a subroutine shown in FIG. 14 similar to the purge-air introduction control subroutine shown in FIG. 7 may be executed, instead of executing the subroutine of FIG. 7.

In this purge-air introduction control subroutine, if it is concluded in Step S70 that the flag $F_{STOP}$ does not take a value of "1", the ECU 50 determines whether or not the value of the flag $F_{LA}$ is "1" (Step S72). If this decision is No, the duty ratio is increased by $\Delta D_{PR}$ (Step S74). In Step S77 used in place of Step S76 in FIG. 7, it is determined whether or not the elapsed time $T_1$ from the start of the PCV driving, measured by the timer activated in Step S18 in FIG. 3, has reached the predetermined time period $T_A$. If the decision in Step S77 is No, the PCV 46 is driven according to the renewed duty ratio "D" (Step S78). The predetermined time period $T_A$ is set, for example, such that, at the moment when the predetermined time period $T_A$ is reached, the duty ratio "D" reaches the threshold value $D_A$ used in the foregoing embodiment. When the elapsed time $T_1$ reaches the predetermined time period $T_A$, thereafter, the flag $F_{LA}$ is set at a value of "1" (Step S84), whereby transition is made from the first half to the second half. As a result, the duty ratio "D" is increased by $\Delta D_{LA}$ larger than $\Delta D_{PR}$ at every execution cycle of this subroutine (Step S86). Since the other control procedures in FIG. 14 are the same as in FIG. 7, explanation will be omitted.

In the fault diagnosis subroutine of the above-mentioned modification, whether or not the elapsed time $T_1$ has reached an upper limit elapsed time (shown by the symbol $T_B$ in FIG. 11), corresponding to the upper limit duty ratio, may be determined, instead of making a determination as to whether or not the duty ratio "D" has reached the upper limit duty ratio (100%) in Step S38 (FIG. 4) in the fault diagnosis subroutine of the preferred embodiment.

Figure 15:
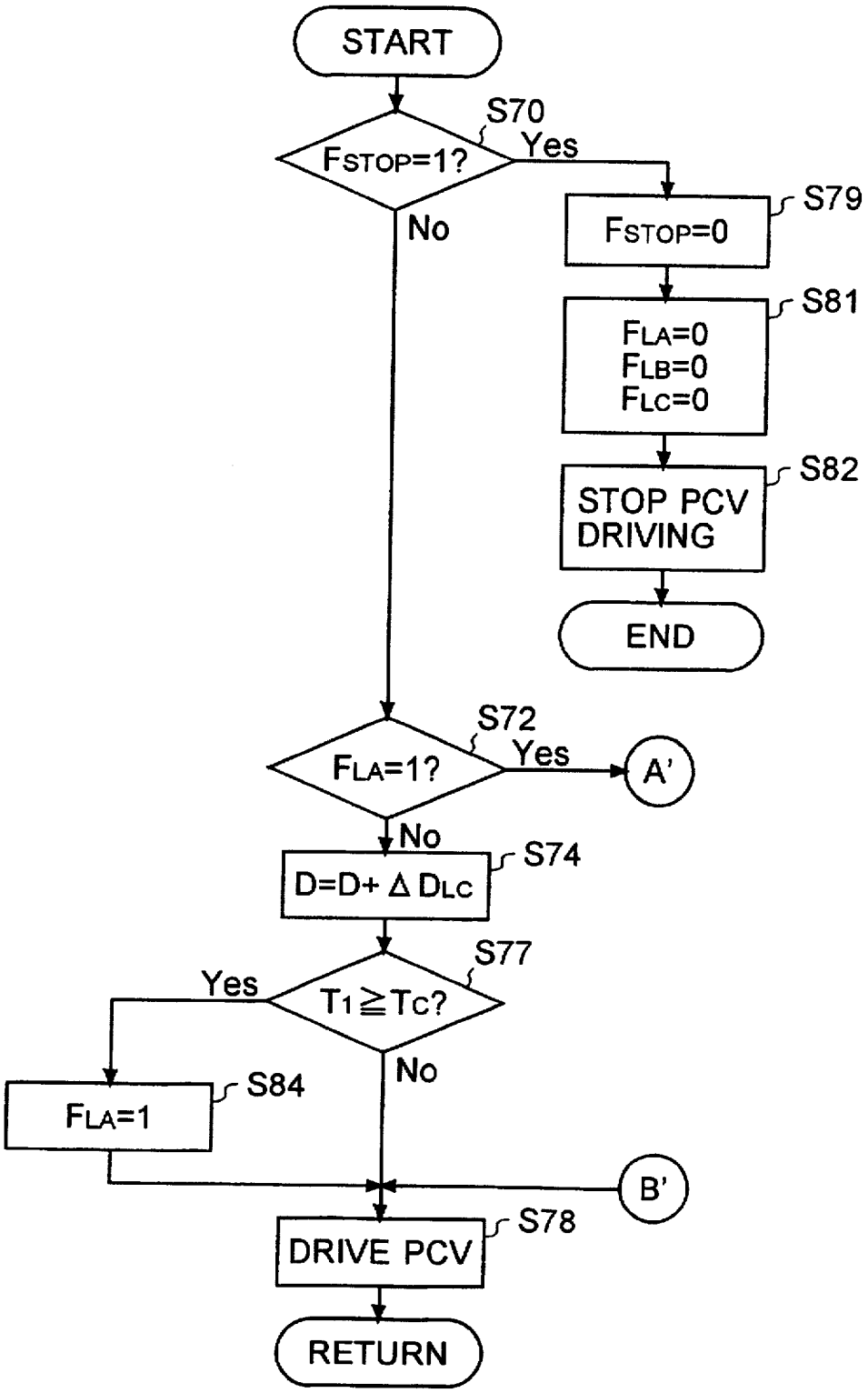
FIG. 15 is a flowchart showing a purge-air introduction control subroutine in the modification shown in FIG. 12.
Figure 16:
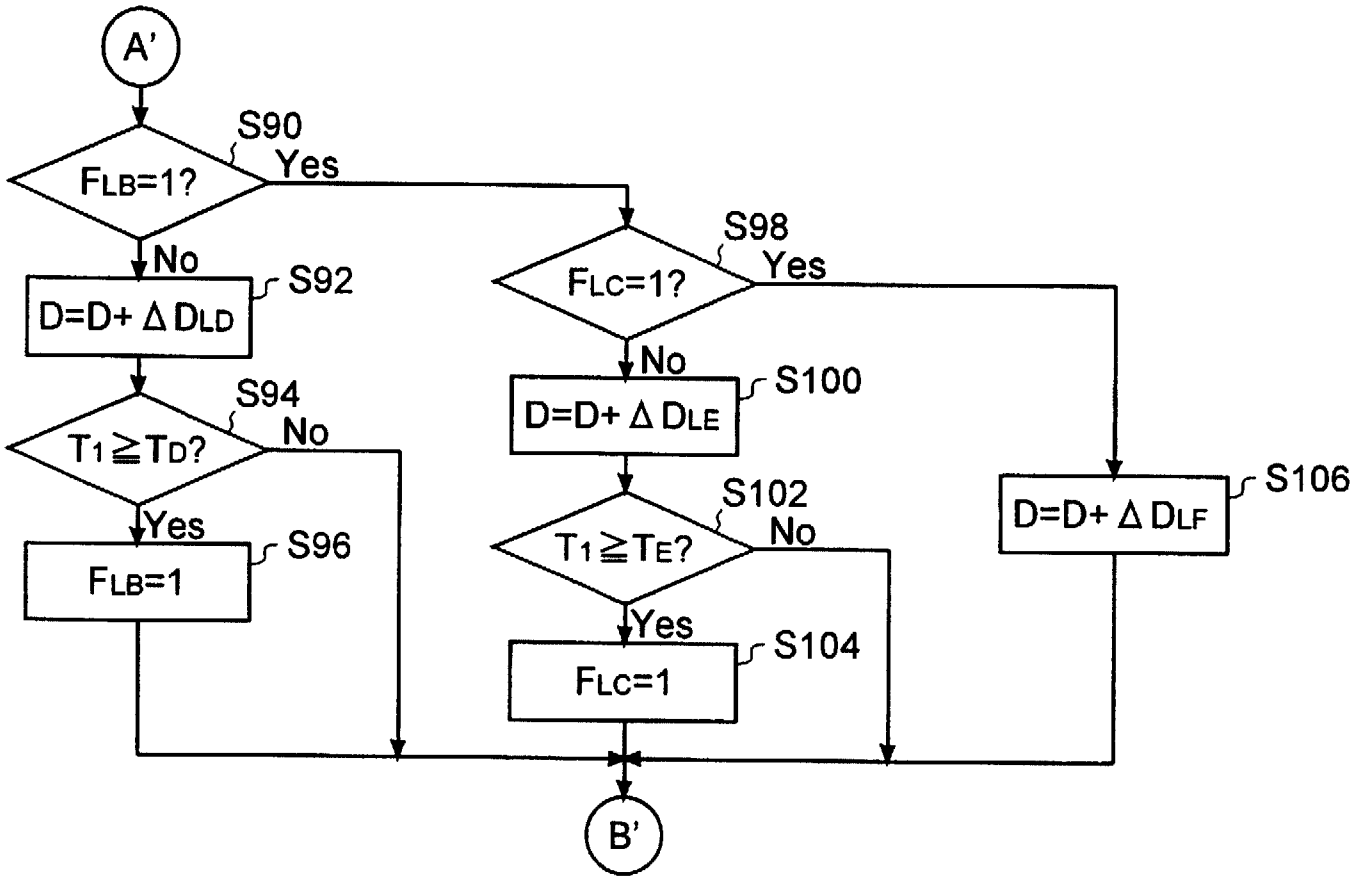
FIG. 16 is a flowchart showing the remainder of the purge-air introduction control subroutine partly shown in FIG. 15.

In case that the increasing degree of the purge-air introduction amount is gradually increased by making transition from the I period to the II period, from the II period to the III period, and from the III period to the IV period when the elapsed time period $T_1$ from the start of the PCV driving reaches the predetermined time periods $T_C$, $T_D$ and $T_E$, respectively, as shown in FIG. 12, a subroutine shown in FIGS. 15 and 16 similar to that shown in FIGS. 7 and 14 can be executed, instead of the purge-air introduction control subroutine shown in FIG. 7.

In this purge-air introduction control subroutine, if it is concluded in Step S70 that the purge-air introduction stop flag $F_{STOP}$ does not take a value of "1" and concluded in Step S72 that the flag $F_{LA}$ does not take a value of "1," then the duty ratio "D" is increased by an increment $\Delta D_{LC}$ smaller than the increment $\Delta D_{PR}$ used in the preferred embodiment (Step S74). In Step S77 used in place of Step S76 in FIG. 7, it is determined whether or not the elapsed time period $T_1$ has reached the predetermined time period $T_C$. If the decision is No, the PCV 46 is driven according to the renewed duty ratio "D" (Step S78). The predetermined time period $T_C$ is set, for example, such that, at the moment when the predetermined time period $T_C$ is reached, the duty ratio "D" reaches a value $D_C$ smaller than the threshold value $D_A$ used in the preferred embodiment (See FIG. 12). When the elapsed time period $T_1$ reaches the predetermined time period $T_C$, thereafter, the flag $F_{LA}$ is set at a value of "1" (Step S84), whereby transition is made from the I period to the II period.

Subsequently, it is determined whether or not a flag $F_{LB}$ takes a value of "1" (Step S90), and if the decision is No, the duty ratio "D" is increased by a value $\Delta D_{LD}$ larger than the value $\Delta D_{LC}$ (Step S92). When it is concluded in Step S94 that the elapsed time period $T_1$ reaches the predetermined time period $T_D$, thereafter, the flag $F_{LB}$ is set at a value of "1," whereby transition is made from the II period to the III period.

In the III period, Steps S98, S100 and S102 corresponding to Steps S90, S92 and S94, respectively, are repeatedly executed, whereby the duty ratio "D" is increased by a value $\Delta D_{LE}$ which is larger than the value $\Delta D_{LD}$. When the predetermined time period $T_E$ has elapsed from the start of the PCV driving, a flag $F_{LC}$ is set at a value of "1" (Step S104), whereby transition is made from the III period to the IV period. In the IV period, the duty ratio "D" is increased by a value $\Delta D_{LF}$ larger than the value $\Delta D_{LE}$ (Step S106). The other control procedures in FIGS. 15 and 16 are the same as in FIG. 7, and hence explanation will be omitted. However, in this purge-air introduction control subroutine, in Step S81 used in place of the Step S80 in FIG.7, the flags $F_{LA}$, $F_{LB}$ and $F_{LC}$ are reset at a value of "0."

In the fault diagnosis subroutine according to this modification, a determination may be made as to whether or not the elapsed time period $T_1$ has reached an upper limit elapsed time period (shown by symbol $T_F$ in FIG. 11), corresponding to this upper limit duty ratio, instead of making the determination on whether or not the duty ratio "D" has reached the upper limit duty ratio (100%) in Step S38 (FIG. 4) in the fault diagnosis subroutine in the preferred embodiment.

Figure 17:
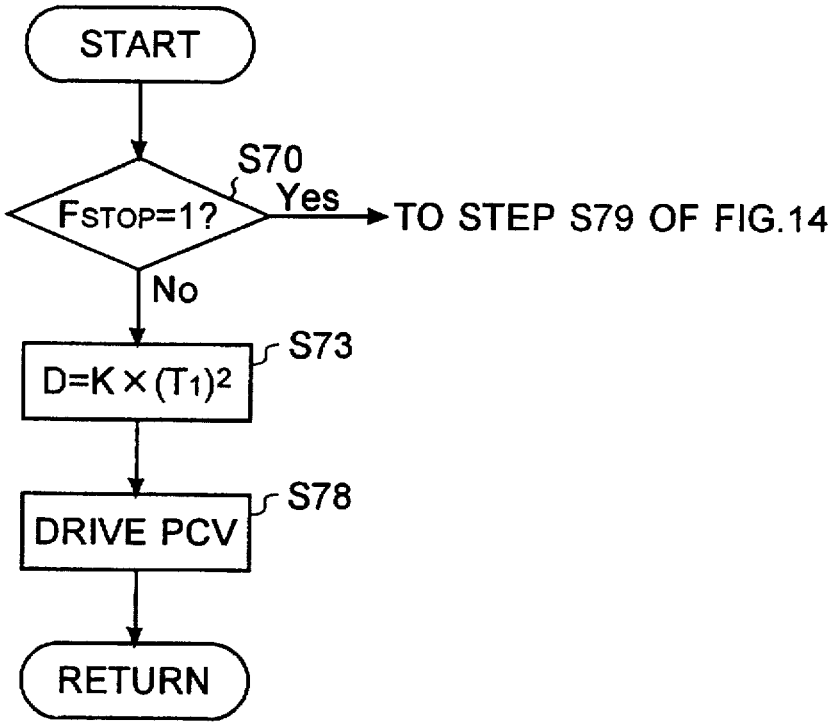
FIG. 17 is a flowchart showing the purge-air introduction control subroutine in the modification shown in FIG. 13.

In case that a duty ratio D1 is increased along a quadratic curve (change rate of the duty ratio "D" is increased according to a simple equation whose variable is the elapsed time period from the start of the PCV driving), as shown in FIG. 13, a subroutine shown in FIG. 17 may be executed, instead of the purge-air introduction control subroutine shown in FIG. 7.

In this purge-air introduction control subroutine, if it is concluded in Step S70 that the purge-air introduction stop flag $F_{STOP}$ does not take a value of "1," the ECU 50 calculates the product of square of elapsed time period $T_1$ and a predetermined factor K, as the duty ratio "D" of the control cycle concerned (Step S73), and the PCV 46 is driven according to the thus calculated duty ratio "D" (Step S78). If the decision in Step S70 is Yes, the control flow advances to Step S79 in FIG. 14.

The present invention is not limited to the foregoing preferred embodiment and its modifications. For example, concrete control procedures and values of the threshold values and increments may be changed within a range not deviating from the purport of the present invention.

What is claimed is:

1. A fault diagnosis apparatus for a fuel evaporative emission suppressing system in which a purge air is introduced into an intake passage through a purge passage, the purge air containing a fuel evaporative gas generated in a fuel supply system of an engine mounted on a vehicle, and an atmospheric air, comprising:

purge regulating means for regulating an introduction amount of the purge air;

operating state detecting means for detecting an operating state information quantity representing an operating state of at least one of the vehicle, the engine, and means for controlling the engine;

purge-air increasing means for controlling said purge regulating means so that a change rate, at which the introduction amount of the purge air is increased, is controlled over time such that, in effect, the change rate is sufficiently slow at least substantially to avoid engine torque fluctuation due to excessive purge air introduction and such that, in effect, the change rate is sufficiently fast at least substantially to avoid an operating state change during a fault diagnosis; and diagnosing means for executing fault diagnosis of the fuel evaporative emission suppressing system based on the operating state information quantity detected by said operating state detecting means after said purge-air increasing means starts control of said purge regulating means.

2. A fault diagnosis apparatus according to claim 1, wherein said purge regulating means operates in response to a commanded operation quantity sent out of said purge-air increasing means, and wherein said purge-air increasing means controls said purge regulating means so that the introduction amount of the purge air is increased at a first change rate till the commanded operation quantity reaches a predetermined quantity, and that the introduction amount of the purge air is increased at a second change rate greater than the first change rate after the commanded operation quantity reaches the predetermined quantity.

3. A fault diagnosis apparatus according to claim 2, wherein said predetermined quantity is an operation quantity of said purge regulating means which realizes introduction of the purge air in an amount to generate a significant change in the operating state information quantity when said purge regulating means is normal.

4. A fault diagnosis apparatus according to claim 2, wherein said diagnosing means repeats fault diagnosis of said fuel evaporative emission suppressing system as long as a variation of the operating state information quantity observed from a moment when said purge-air increasing means started control of said purge regulating means is less than a predetermined decision reference value, and wherein said diagnosis means concludes that said fuel evaporative emission suppressing system is normal if the variation of the operating state information quantity exceeds the predetermined decision reference value.

5. A fault diagnosis apparatus according to claim 2, wherein said diagnosing means concludes that the fuel evaporative emission suppressing system is faulty if a variation of the operating state information quantity observed from a moment when said purge-air increasing means started control of said purge regulating means to a moment when the commanded operation quantity or the elapsed time has reached a predetermined upper limit is less than a predetermined decision reference value.

6. A fault diagnosis apparatus according to claim 2, wherein said purge regulating means includes a purge regulating valve which is opened and closed in accordance with a commanded duty ratio sent out of said purge-air increasing means to thereby regulate a flow rate of the purge air flowing through the purge passage, and wherein said purge-air increasing means changes the commanded duty ratio so as to increase at a first duty-ratio change rate till the commanded duty ratio reaches a predetermined duty ratio and to increase at a second duty-ratio change rate greater than the first duty ratio after the predetermined duty ratio is reached.

7. A fault diagnosis apparatus according to claim 6, wherein said diagnosing means repeats fault diagnosis of the fuel evaporative emission suppressing system as long as a variation of the operating state information quantity observed from a moment when said purge-air increasing means started control of said purge regulating means is less than a predetermined decision reference value, and concludes that the fuel evaporative emission suppressing system is normal if the variation of the operating state information quantity exceeds the predetermined decision reference value.

8. A fault diagnosis apparatus according to claim 6, wherein said diagnosing means concludes that the fuel evaporative emission suppressing system is faulty if a variation of the operating state information quantity observed from a moment when said purge-air increasing means started sending of the commanded duty ratio to said purge regulating means to a moment when the commanded duty ratio has reached a predetermined upper limit duty ratio is less than a predetermined decision reference value.

9. A fault diagnosis apparatus according to claim 2, wherein the engine is controlled by an engine controlling means, and wherein said engine controlling means comprises an air-fuel ratio detecting means for detecting an air-fuel ratio of an air-fuel mixture supplied to the engine, a control correction quantity setting means for setting, based on a detection result obtained by said air-fuel ratio detecting means, a control correction quantity for feedback control to control the air-fuel ratio of the mixture to a predetermined target air-fuel ratio, a fuel supply amount regulating means for regulating an amount of fuel supplied to the engine, and a fuel controlling means for drivingly controlling said fuel supply amount regulating means based on the control correction quantity set by said control correction quantity setting means, and wherein said operating state detecting means detects the control correction quantity set by said control correction quantity setting means, as the operating state information quantity.

10. A fault diagnosis apparatus according to claim 2, wherein the engine is controlled by an engine controlling means, wherein said engine controlling means comprises an intake air regulating means for regulating an amount of air sucked into the engine through the intake passage so that an idling speed of the engine is kept almost constant, and wherein said operating state change detecting means detects an operation quantity of said intake air regulating means as said operating state information quantity.

11. A fault diagnosis apparatus according to claim 2, wherein said operating state change detecting means detects rotational speed of the engine as the operating state information quantity.

12. A fault diagnosis apparatus according to claim 1, wherein said purge-air increasing means controls said purge regulating means so that the introduction amount of the purge air is increased at a first change rate till a predetermined time period has elapsed from a moment when the control was started, and controls said purge regulating means so that the introduction amount of the purge air is increased at a second change rate greater than the first change rate after the predetermined time period has elapsed.

13. A fault diagnosis apparatus according to claim 12, wherein the predetermined time period is an operation time period of said purge regulating means which realizes introduction of the purge air in an amount to generate a significant change in the operating state information quantity when said purge regulating means is normal.

14. A fault diagnosis apparatus according to claim 12, wherein said diagnosing means repeats fault diagnosis of said fuel evaporative emission suppressing system as long as a variation of the operating state information quantity observed from a moment when said purge-air increasing means started control of said purge regulating means is less than a predetermined decision reference value, and wherein said diagnosis means concludes that said fuel evaporate emission suppressing system is normal if the variation of the operating state information quantity exceeds the predetermined decision reference value.

15. A fault diagnosis apparatus according to claim 12, wherein said diagnosing means concludes that the fuel evaporative emission suppressing system is faulty if a variation of the operating state information quantity observed from a moment when said purge-air increasing means started control of said purge regulating means to a moment when the commanded operation quantity or the elapsed time has reached a predetermined upper limit is less than a predetermined decision reference value.

16. A fault diagnosis apparatus according to claim 12, wherein the engine is controlled by an engine controlling means, and wherein said engine controlling means comprises an air-fuel ratio detecting means for detecting an air-fuel ratio of an air-fuel mixture supplied to the engine, a control correction quantity setting means for setting, based on a detection result obtained by said air-fuel ratio detecting means, a control correction quantity for feedback control to control the air-fuel ratio of the mixture to a predetermined target air-fuel ratio, a fuel supply amount regulating means for regulating an amount of fuel supplied to the engine, and a fuel controlling means for drivingly controlling said fuel supply amount regulating means based on the control correction quantity set by said control correction quantity setting means, and wherein said operating state detecting means detects the control correction quantity set by said control correction quantity setting means, as the operating state information quantity.

17. A fault diagnosis apparatus according to claim 12, wherein the engine is controlled by an engine controlling means, wherein said engine controlling means comprises an intake air regulating means for regulating an amount of air sucked into the engine through the intake passage so that an idling speed of the engine is kept almost constant, and wherein said operating state change detecting means detects an operation quantity of said intake air regulating means as said operating information quantity.

18. A fault diagnosis apparatus according to claim 12, wherein said operating state change detecting means detects rotational speed of the engine as the operating state information quantity.

* * * * *